US005556594A

United States Patent [19]

Frank et al.

[11] Patent Number: 5,556,594

[45] Date of Patent: Sep. 17, 1996

[54] CORROSION RESISTANT AGE HARDENABLE NICKEL-BASE ALLOY

[75] Inventors: Richard B. Frank, Muhlenberg Township; Terry A. DeBold, Wyomissing; Sunil Widge, Dryville; James W. Martin, Spring Township, all of Pa.

[73] Assignee: CRS Holdings, Inc., Wilmington, Del.

[21] Appl. No.: 869,138

[22] Filed: May 30, 1986

[51] Int. Cl.[6] ..... C22C 19/05

[52] U.S. Cl. ..... 420/448; 148/410; 148/427; 148/428

[58] Field of Search ..... 420/448; 148/162, 148/410, 427, 428, 677

[56] References Cited

U.S. PATENT DOCUMENTS

| | | | |
|---|---|---|---|
| 3,046,108 | 7/1962 | Eiselstein | 75/171 |
| 3,160,500 | 12/1964 | Eiselstein et al. | 75/171 |
| 3,972,752 | 8/1976 | Honnorat et al. | 148/162 |
| 4,400,210 | 8/1983 | Kudo et al. | 420/443 |
| 4,400,211 | 8/1983 | Kudo et al. | 420/443 |
| 4,652,315 | 5/1987 | Igarashi et al. . | |
| 4,788,036 | 11/1988 | Elselstein et al. . | |

FOREIGN PATENT DOCUMENTS

| | | |
|---|---|---|
| 66361 | of 0000 | European Pat. Off. . |
| 8256480 | 7/1982 | European Pat. Off. . |
| 8392397 | 10/1983 | European Pat. Off. . |

OTHER PUBLICATIONS

Sims and Hagle, *The Superalloys*, pp. 115–117.

R. B. Frank and T. A. DeBold, "A New Age–Hardenable, Corrosion–Resistant Alloy".

Carpenter Technology Corporation, Reading, Pa. Technical Data, Pyromet 625, as published 1979.

*Primary Examiner*—David A. Simmons

*Assistant Examiner*—Margery S. Phipps

*Attorney, Agent, or Firm*—Dann, Dorfman, Herrell and Skillman, P.C.

[57] ABSTRACT

An age hardenable nickel base chromium, molybdenum, alloy as well as intermediate products and articles made therefrom are disclosed which, in the solution treated and age hardened condition, have a 0.2% yield strength greater than 100 ksi combined with resistance to pitting and crevice corrosion and to stress corrosion cracking in chloride and sulfide environments at elevated temperatures up to about 500° F. without requiring working below the recrystallization temperature of the alloy. Broad and preferred ranges are disclosed as follows:

| | Broad (w/o) | Preferred (w/o) |
|---|---|---|
| C | 0.1 Max. | 0.03 Max. |
| Mn | 5 Max. | 2 Max. |
| Si | 1 Max. | 0.5 Max. |
| P | 0.03 Max. | 0.015 Max. |
| S | 0.03 Max. | 0.010 Max. |
| Cr | 16–24 | 18–22 |
| Mo | 7–12 | 7.5–11 |
| W | 4 Max. | — |
| Nb | 2–6 | 2.75–4.25 |
| Ti | 0.50–2.5 | 0.75–1.5 |
| Al | Trace–1 | 0.05–0.35 |
| B | 0.02 Max. | 0.001–0.006 |
| Zr | 0.50 Max. | 0.08 Max. |
| Co | 5 Max. | — |
| Cu | 0–3 | 0.5 Max. |
| N | 0.04 Max. | 0.01 Max. |
| Fe | 20 Max. | 2–14 |

the balance being at least about 55% nickel, the sum of the percent chromium and molybdenum being not greater than 31, and the sum of the percent niobium, titanium and aluminum being such that the total atomic percent thereof is about 3.5 a/o to 5 a/o when calculated as 0.64(w/o Nb)+1.24(w/o Ti)+2.20(w/o Al).

34 Claims, No Drawings

CORROSION RESISTANT AGE HARDENABLE NICKEL-BASE ALLOY

BACKGROUND OF THE INVENTION

This invention relates to a nickel-base alloy and more particularly to such an alloy and products made therefrom having a unique combination of corrosion resistance and age or precipitation hardenability properties in the heat treated condition and without requiring working below the alloy's recrystallization temperature.

The ever-widening search for fossil fuels has resulted in increasing demands for an alloy having improved corrosion resistance and yield strength to overcome the conditions encountered by equipment required to explore and then exploit sour wells. Particularly in deep sour wells, the conditions usually encountered are such that good pitting and crevice corrosion resistance and stress corrosion cracking resistance are required combined with high strength and ductility. In such environments $Cl^-$, $H_2S$ and $CO_2$ are present at elevated pressure and temperature. The strengths required are greater than 100 ksi 0.2% yield strength (YS), preferably greater than 120 ksi, in the age hardened rather than cold worked condition because the parts do not lend themselves to being cold worked and, if at all, only with difficulty and excessive expense. An alloy capable of meeting such rigorous requirements has long been desired for use in the manufacture of components for use in sour wells. Such material would also be well suited for use in other applications involving exposure of members of complex shape or relatively large section to environments requiring outstanding resistance to chlorides and/or sulfides under high stress such as in the chemical process industry or in other industries requiring outstanding stress cracking resistance.

U.S. Pat. No. 3,160,500 granted Dec. 8, 1964 to H. L. Eiselstein and J. Gadbut relates to a matrix-stiffened alloy described as having high strength containing 55–62% Ni, 7 to 11% Mo, 3 to 4.5% Nb, 20–24% Cr, up to 8% W 0.1% Max. C, 0.5% Max. Si, 0.5% Max. Mn, 0.015% Max. B, 0.40% Max of a deoxidizer selected from the group consisting of Al and Ti and the balance essentially Fe but not more than 20%. Here and elsewhere throughout this application, percent is given as weight percent (w/o) unless otherwise indicated. The alloy is further characterized as having at least about 60 ksi 0.2% YS (414 $MN/m^2$) at room temperature and being essentially non-age hardenable, non-age hardenable being defined in the U.S. Pat. No. 3,160,500 as a maximum increase in yield strength of 20 ksi (138 $MN/m^2$) when subjected to a heat treatment at a temperature of about 1100 to 1300 F. as compared to the yield strength of the alloy in the annealed condition. According to the patent, the total amount of aluminum plus titanium present in the alloy is not to exceed 0.4% "as otherwise the alloys tend to become age hardenable" (Col. 2, lines 45–49). Alloys 1–3 exemplifying the claimed subject matter and two alloys (identified here as Alloys A and B) described as outside the patented invention, are set forth in Table I where the 0.2% YS (ksi) at room temperature in the annealed condition (1900 F., 1 hour) as reported in the patent are also given.

TABLE I

| | 1 | 2 | 3 | A | B |
|---|---|---|---|---|---|
| C | 0.02 | 0.02 | 0.03 | | 0.04 |
| Mn | 0.12 | 0.11 | 0.12 | | 0.15 |
| Si | 0.05 | 0.04 | 0.11 | | |
| Cr | 21.68 | 21.41 | 21.44 | 21.76 | 21.4 |
| Mo | 9.10 | 8.83 | 8.99 | 9.07 | 5.1 |

TABLE I-continued

| | 1 | 2 | 3 | A | B |
|---|---|---|---|---|---|
| W | — | 5.32 | — | — | — |
| Nb | 4.30 | 4.27 | 4.19 | 4.37 | 1.2 |
| Ti | 0.15 | 0.13 | 0.20 | | 0.67 |
| Al | 0.23 | 0.20 | 0.16 | | 0.6 |
| Ni | 57.46 | Bal. | Bal. | 50.8 | Bal. |
| Fe | Bal. | 1.92 | 3.30 | Bal. | 17.1 |
| .2% YS | 73.3 | 92 | 75.2 | 66.5 | 49.5 |

With regard to Table I it is to be noted that tungsten was reported only in connection with Alloy 2. Alloy A was described as being "similar in composition" to Alloy 1 except as indicated (Pat., col. 4, lines 10 & 11). Alloy B was characterized as having "age hardened strongly but had a yield strength at room temperature of only 49,500 psi, . . . when tested after a 1900 F. anneal."

A commercial alloy has long been on sale by the assignee of this application under its trademark Pyromet 625 with the composition set forth in Table IA.

TABLE IA

| | w/o | | w/o |
|---|---|---|---|
| C | 0.10 Max. | Fe | 5.00 Max. |
| Mn | 0.50 Max | Ti | 0.40 Max. |
| Si | 0.50 Max. | Co | 1.00 Max. |
| P | 0.015 Max. | Nb (+Ta) | 3.15–4.15 |
| S | 0.015 Max. | Al | 0.40 Max. |
| Cr | 20.0–23.0 | Ni | Bal. |

Thus, while Type 625 alloy as well as other compositions of the 3,160,500 patent are characterized by outstanding corrosion resistance particularly resistance to chlorides, sulfides and carbon dioxide, combined with stability at elevated temperatures, this combination of properties was achieved by eliminating age or precipitation hardening for all practical purposes because of the prohibitively long time required at the elevated temperature required for age hardening.

U.S. Pat. No. 3,046,108 was granted to H. L. Eiselstein on Jul. 24, 1962 for an age-hardenable nickel alloy containing 0.2 Max. C, 1% Max. Mn, 0.5% Max. Si, 10–25% Cr, 2–5% or 7% Max. Mo, 3–9% Nb+Ta, 0.2–2% Ti, 0.2–2% Al, (Ti+Al≦2.5%) 0.02% Max. B, 0.5% Max. Zr, 40% Max. Co, 40% Max. Fe and 45–80% Ni+Co with nickel≧30% and Co≦40%. According to the patent a preferred composition contains 0.03% C, 0.18% Mn, 0.27% Si, 21% Cr, 0.6% Al, 0.6% Ti, 4% Nb, 3% Mo, 0.009% B, 53% Ni and balance Fe. In a further variation, iron is limited to 20% Max. with 60–75% Ni+Co, Co≦40%. While an alloy within the range of this patent has been available as Pyromet 718 (trademark of the assignee of the present application) characterized by high strength, stress rupture life and ductility at elevated temperatures, it and other compositions of the 3,046,108 patent have not provided the desired corrosion resistance in environments containing chlorides, sulfides and carbon dioxide at elevated temperatures required for use in sour wells.

European Patent Application No. 92,397 published Oct. 26, 1983, on the other hand is expressly directed to providing an alloy suitable for use in sour gas wells where corrosion resistance is required to sulfides, carbon dioxide, methane and brine (chlorides) at temperatures up to 300 C. This publication suggests that the most likely causes of failure under such conditions are sulfide stress corrosion cracking, chloride stress corrosion cracking, pitting and general corrosion. The application goes on to propose an alloy having the required corrosion resistance and high yield strength, which is cold workable but not age-hardening containing 15–30% Cr, 5–15% Mo (Cr+Mo=29–40%) 5–15% Fe (Cr+Mo+Fe≦46%), C≦0.06%, Al and/or Ti≦1%, Si≦1%, Nb≦0.5% Mn<0.3%, Bal Ni. The preferred alloy of this publication asserted to have a yield strength in excess of 1000 $MN/m^2$ (>145 ksi) is said to consist of 20–30% Cr, 7–12% Mo, (Cr+Mo=29–40% and Cr–2×Mo=2–12%), 5–15% Fe, Cr+Mo+Fe≦46%, 0.05–0.5% Al and/or Ti, C≦0.06%, Nb≦0.5%, Si≦0.5%, Mn≦0.2%, Bal. Ni. Among Alloys A–X, there are six compositions outside the claimed subject matter of the 92,397 application, Alloys F–L, containing 1.9–3.1% Nb but only Alloy K contains a significant amount of Ti for consideration here. Thus, Alloy K in addition to Ni and the usual incidental elements is reported in the publication as containing 0.034% C, 24.7% Cr, 10.1% Mo, 0% Fe, 0.25% Al, 1.40% Ti and 3.1% Nb. Apart from Table I, the only reference to Alloy K to be found in the 92,397 publication is in Table IV where, in the results of chloride stress corrosion tests, Alloy K is reported to have failed in 62 days when exposed to a temperature of 288 C. in the U-bend test, the outer fiber stress of the U-bend specimen being 1310 $MN/m^2$ (190 ksi). Alloy H containing 18.8% Cr, 7.9% Mo, 16.8% Fe, 0.007% C, 0.11% Al, 0.11% Ti, 3.1% Nb and the Bal. Ni according to Table II passed the NACE $H_2S$ stress corrosion test with an applied stress level of 1200 $MN/m^2$ (174 ksi) but according to Table IV, Alloy H failed the chloride stress corrosion test in 28 days. Thus, the EPA 92,397 publication leads to the conclusion that to achieve high yield strength and resistance to corrosion including stress corrosion in environments encountered in sour wells requires a non-age-hardenable alloy with no more than 0.5% columbium.

U.S. Pat. Nos. 4,400,210 and 4,400,211 granted Aug. 23, 1983 to T. Kudo et al. and Japanese Publication No. 82-203740 December 1982, are all assigned to Sumitomo Metal Ind. KK., and state they relate to alloys for making high strength well casing and tubing having improved resistance to stress corrosion cracking in media containing sulfides, chlorides and carbon dioxide such as is encountered in deep wells. The U.S. Pat. Nos. 4,400,210 and 4,400,211 (Col. 2) assert that "cold working seriously decreases resistance to stress corrosion cracking" but seek to overcome the adverse effect of cold working by the presence of Cr, Ni, Mo and W in the surface layer of a casing or tubing. These two U.S. patents and the Japanese publication specify the composition set forth therein as containing 0.5–4% of at least one of Nb, Ti, Zr, Ta, and V. The 4,400,210 and 4,400,211 patents (Col. 6) and presumably also the Japanese publication state the elements Nb, Ti, Zr, Ta and V are equivalent to each other in providing precipitation (age) hardening due to the formation of an intermetallic compound with Ni.

EPA Publication No. 82-56480 published Jul. 28, 1982 relates to a nickel base alloy having resistance to stress corrosion cracking in contact with water at elevated temperature as in boiling water nuclear reactors or pressurized water reactors. The proposed alloy is described as consisting essentially of 15–25% Cr, 1–8% Mo, 0.4–2% Al, 0.7–3% Ti, 0.7–4.5% Nb and the balance Ni, strengthened by gamma prime and/or gamma double prime. The gamma prime phase is defined as an intermetallic compound of $Ni_3(Al, Ti)$ and the gamma double prime phase as an intermetallic compound of $Ni_3Nb$. This publication directly contradicts the assertions of the U.S. Pat. Nos. 4,400,210 and 4,400,211 regarding the equivalence of the elements Nb, Ti, Zr, Ta and V in providing age hardening. The EPA 82-56480 publication (page 7) states that the addition of Nb is essential for obtaining high hardenability but must be combined with at least 0.4% Al and more than 0.7% Ti to obtain an appreciable age hardenability. Of the many alloys for which specific analyses are given only one, Alloy K, a reference alloy in Table 2, contains more than 4.2% Mo. As set forth in Table 2, Alloy K contains 23.3% Cr, 8.8% Mo, 4.9% Fe, 0.04% C, 0.5% Al, 1.2% Ti, 2.4% Nb and Bal. Ni. Alloy K is noted as having cracked during forging.

There is in addition a considerable quantity of publications including patents both domestic and foreign containing broad composition ranges which overlap in varying degrees with the composition ranges set forth hereinabove but none appears to come any closer to the alloy and articles made therefrom of the present application or, more particularly, to providing a composition suitable for use in sour wells. Nevertheless, there has been an increasing need for an alloy and products made therefrom having a better combination of strength and corrosion resistance, especially an alloy and products made therefrom suitable for use in environments containing sulfides, chlorides and carbon dioxide under high stress without requiring warm or cold working. It is a significant drawback of such prior compositions as disclosed in said U.S. Pat. No. 3,160,500 and said EPA Publication No. 92,397 that substantial cold reduction is required to reach the level of strength at which parts made therefrom are intended to be used especially in the case of large or massive parts. On the other hand, age hardenable compositions as exemplified by said U.S. Pat. No. 3,046,108, though age hardenable to a desirably high strength, leave much to be desired with regard to corrosion resistance, particularly resistance to cracking under stress in media containing sulfides, chlorides and carbon dioxide as encountered in sour wells.

BRIEF SUMMARY OF THE INVENTION

It is, therefore, a principal object of this invention to provide an age hardenable nickel base chromium-molybdenum-containing alloy and articles made therefrom which without being warm or cold worked have a unique combination of strength and corrosion resistance particularly to pitting and crevice corrosion and resistance to stress corrosion cracking under high stress in severely corrosive environments.

Another object is to provide such an alloy and articles made therefrom characterized by high resistance to pitting and crevice corrosion and to stress corrosion cracking in the presence of chlorides, sulfides and/or carbon dioxide at elevated pressures and temperatures while being hardenable by heat treatment to a 0.2% yield strength of greater than about 100 ksi (about 690 $MN/m^2$) without the need for working below the recrystallization temperature, that is warm or cold working.

A further object is to provide such an alloy and articles made therefrom that are highly resistant to such corrosion in the chloride-, sulfide-, and carbon dioxide-bearing media at the elevated pressures and temperatures, e.g., up to about 500 F. (about 300 C.) encountered in deep sour oil and/or gas wells.

Much of the foregoing as well as additional objects and advantages are attained by providing a nickel base, chromium-molybdenum-containing alloy in which the elements Ni, Cr, Mo, Nb, Ti and Al, are balanced as indicated in abbreviated form in Table II and in the following description.

TABLE II

| | Broad (w/o) | Preferred (w/o) |
|---|---|---|
| C | 0.1 Max. | 0.03 Max. |
| Mn | 5 Max. | 2 Max. |
| Si | 1 Max. | 0.5 Max. |
| P | 0.03 Max. | 0.015 Max. |
| S | 0.03 Max. | 0.010 Max. |
| Cr | 16–24 | 18–22 |
| Mo | 7–12 | 7.5–11 |
| Nb | 2–6 | 2.75–4.25 |
| Ti | 0.50–2.5 | 0.75–1.5 |
| Al | Trace–1 | 0.05–0.35 |
| B | 0.02 Max. | 0.001–0.006 |
| Zr | 0.50 Max. | 0.08 Max. |
| W | 4 Max. | — |
| Co | 5 Max. | — |
| Cu | 0–3 | 0.5 Max. |
| N | 0.04 Max. | 0.01 Max. |
| Fe | 20 Max. | 2–14 |

The balance of the composition is nickel, but not less than 55%, and in which the sum of the chromium and molybdenum contents in weight percent (w/o) is not greater than 31. Preferably at least 57%, better yet at least about 59% nickel is present. It is also essential in this composition that the hardener content of Nb+Ti+Al be about 3.5 to 5 atomic percent (a/o). In this connection it may be noted that for the composition as specified in Table II and those in Tables III and IIIA hereinbelow, hardener content in weight percent can be converted to atomic percent hardener with reasonable accuracy using the following simplified relationship: Hardener a/o=0.64 (w/o Nb)+1.24 (w/o Ti)+2.20 (w/o Al). And nickel weight percent is so close to atomic percent that they are interchangeable for the purposes of this application. Other elements can be present which aid in making and processing the alloy or which do not objectionably detract from the desired properties. The broad range of one or more elements may be used with the preferred ranges of other elements. Also the stated broad maximum or minimum of one or more elements can be used with their preferred maximums or minimums respectively in Table II and hereinafter. Here and throughout this application it is intended by reference to niobium to include the usual amount of tantalum found in commercially available niobium bearing alloys used in making alloying additions of niobium to commercial alloys.

DETAILED DESCRIPTION

In this nickel-base composition, in addition to nickel the essential elements are chromium, molybdenum, niobium, titanium and aluminum. Optional elements and the usual incidental impurities may also be present.

Carbon and nitrogen are not considered to be desirable additions in this composition because each can have an adverse effect upon corrosion resistance and because each interferes with the desired hardening reaction, carbon by tying up niobium and titanium, and nitrogen by tying up titanium. Thus, carbon is limited to no more than about 0.1% and preferably to no more than about 0.03% or better yet to no more than about 0.02%. Nitrogen is limited to no more than about 0.04% or even to a maximum of about 0.03% and is preferably limited to no more than about 0.01%. To offset the adverse effect on the hardening reaction particularly when the carbon content is about 0.06% or more, the hardener elements, niobium and titanium, are present in the larger amounts indicated by their ranges. While better results can be attained with extremely low levels of carbon present, e.g. less than about 0.005% or less than about 0.003%, the cost of reducing carbon below 0.01% makes that a practical minimum for carbon when the added cost would not be warranted.

Manganese may be present in amounts up to about 5% but it is preferably kept low, to no more than about 2%, better yet to no more than about 0.5% or even no more than about 0.2%, because manganese increases the tendency for grain boundary precipitation and reduces intergranular corrosion resistance, and pitting and crevice corrosion resistance. Preferably, the larger amounts of manganese when present are at the expense of the larger amounts of iron contemplated in this alloy.

While silicon may be present it is preferably kept low because it promotes the formation of unwanted Laves phase and excessive amounts of silicon can affect weldability and hot workability. Thus, silicon is limited to no more than about 1%, preferably no more than about 0.5% and better yet no more than about 0.2%. Phosphorus and sulfur are considered impurities in this alloy because both adversely affect hot workability and cleanliness of the alloy and promote hydrogen embrittlement. Therefore, phosphorus and sulfur are kept low, less than about 0.03% each. Preferably phosphorus is limited to 0.015% Max. and sulfur to 0.010% Max.

Other elements may also be present in relatively small amounts which contribute to a desired property. For example, cobalt contributes to corrosion resistance when present in this composition and to that end may replace nickel on a weight-for-weight basis. However, the cost of cobalt is now and is expected to continue to be greater than nickel so that the extent of the benefit gained from a given addition of cobalt must be weighed against the cost thereof. For that reason, cobalt is limited to a maximum of 5% but at least 55% nickel is preferred. Also, up to about 4% tungsten can be substituted for its equivalent percent molybdenum, that is about 2% by weight tungsten for each 1% by weight molybdenum replaced, when it may be beneficial but at least about 7% molybdenum must be present.

Boron up to a maximum of about 0.02% may be present in this alloy. Even though many of the advantages of the present alloy can be attained without a boron addition, it is preferred for consistent best results that a small amount of boron of about 0.001% to about 0.006% Max. be present. Also to aid in refining the alloy, up to about 0.50% Max. preferably not more than 0.08% Max. zirconium may be present and from a few hundredths up to about a tenth of a percent of other elements such as magnesium, calcium or one or more of the rare earths may be added.

Copper may be present in this alloy when it may be exposed to sulfuric acid-bearing media or it is desired to ensure maximum resistance to chloride and sulfide stress corrosion cracking at elevated temperature when its adverse effect, if any, on pitting, crevice and intergranular corrosion resistance can be tolerated. To that end, up to about 3%, preferably no more than 2.0%, copper may be present.

Iron also is not an essential element in this composition and, if desired, may be omitted. Because commercially available alloying materials contain iron it is preferred to reduce melting costs by using them. It is also believed that iron contributes to resistance to room temperature sulfide stress-cracking. Thus, up to about 20% Max. iron may be present but about 2% to no more than about 14% is preferred.

Chromium, molybdenum, niobium, titanium, aluminum and nickel are critically balanced to provide the uniquely outstanding combination of strength and corrosion resistance properties characteristic of the alloy provided by the present invention. The larger amounts of chromium and molybdenum in their stated ranges of 16–24% Cr and 7–12% molybdenum detract from the hot workability of this composition and, in accordance with this invention, the percent chromium plus the percent molybdenum is not to exceed 31, that is:

$$\% \text{ Cr} + \% \text{ Mo} \leqq 31 \qquad \text{Eq. 1}$$

In other words, as the chromium content of this composition is increased above 19% to 24%, the maximum tolerable molybdenum is proportionately reduced on a one-for-one weight percent basis from 12% to 7%. Because the larger amounts of chromium (≧22%) or molybdenum (>11%) may result in the precipitation of deleterious phases, they are preferably avoided with only about 55% nickel and a minimum of 57% or better yet 59% nickel is preferred.

The elements niobium, titanium, and aluminum take part in the age hardening reaction by which the present composition is strengthened by heat treatment and without requiring warm or cold working. This invention in part stems from the discovery that the elements niobium and titanium together with smaller amounts of aluminum in the critical proportions specified herein in relation to each other and to the elements chromium, molybdenum and nickel provide a high 0.2% yield strength combined with a high level of corrosion resistance suitable for use under a wide variety of conditions and, when balanced as indicated to be preferred herein, provide a composition suitable for use under the rigorous conditions to be encountered in deep sour wells. This unique combination of high strength and corrosion resistance is obtained while attempts to strengthen such nickel base chromium-molybdenum compositions with titanium or with titanium and aluminum resulted in lower strength and a reduction in corrosion resistance together with excessive intergranular carbide precipitation during aging. Compositions strengthened primarily with niobium and titanium, in accordance with the present invention differ from those strengthened with titanium or titanium and aluminum in that the titanium and the titanium plus aluminum strengthened material showed extensive intergranular precipitation of chromium-rich carbides ($M_{23}C_6$) during aging which occurred independent of the chromium and molybdenum content.

As in the case of the elements chromium and molybdenum, the hardener elements niobium, titanium and aluminum must be carefully balanced if the high strength of this composition provided by the age hardening reaction is not to result in an unwanted reduction in corrosion resistance. While the broad range for niobium has been stated as about 2–6% and for titanium about 0.50–2.5%, for better corrosion resistance a preferred niobium range is about 2.5–5% or better yet 2.75–4.25% and a preferred titanium range is about 0.6 to 2% or even better yet about 0.7 to 2.0%. It has been found that in this composition for better crevice corrosion resistance at 55 C. as measured in 6% $FeCl_3$+1% HCl for 72 hours the preferred minimum for titanium is again about 0.6% while a minimum of about 2.75% niobium and at least about 1.1% titanium is used for best crevice corrosion resistance.

In this composition the total hardener content should range from 3.5 a/o up to about 5 a/o and better yet should not exceed about 4.5 a/o for a better all around combination of properties as described herein. When adjusting the balance of a particular composition, increasing the level of niobium and titanium present results in higher strength but because nickel takes part in the strengthening reaction to form the desired intragranular precipitate, nickel should be increased whenever the hardener content is increased with the ratio of the atomic percent increase in nickel to the atomic percent increase in hardener content being 3 to 1 to compensate for the additional nickel removed from the alloy matrix. In this way, the adverse effect of undesired phases, such as sigma phase, and their attendant adverse effect can be avoided. On the other hand, aluminum is beneficial in stabilizing the desired intragranular precipitate and relatively small amounts are found advantageous. It has also been noted that above about 0.25%, that is at about 0.35% and above, aluminum does not appear to add to but rather to detract from the yield strength at room temperature. Therefore, while up to about 1% aluminum can be present, for better results, particularly higher yield strength, aluminum is limited to no more than 0.5%. In this regard, it is also to be noted that when the larger amounts of aluminum objectionably affect the room temperature yield strength, the strength of the composition can be increased by using a lower solution or a higher primary aging temperature. Also, if the tolerable maximum amounts of niobium and/or titanium are not already present then one or both may be increased. Therefore, aluminum amounts in excess of 0.35% (0.77 a/o) are not to be included in atomic percent determinations throughout this specification but only insofar as room temperature yield strength is concerned.

The alloy of this invention can be melted and hot worked using techniques that are well known and conventionally used in the commercial production of nickel-base alloys. A double melting practice is preferred such as melting in the electric arc furnace plus argon-oxygen decarburization or vacuum induction melting, to prepare a remelt electrode followed by remelting, e.g. consumable remelting. Deoxidation and desulfurization with magnesium and/or calcium when used contributes to hot workability. Additions of rare earths, e.g. in the form of misch metal which is primarily a mixture of cerium and lanthanum, or yttrium may also be beneficial. Small amounts of boron and/or zirconium also stabilize grain boundaries and may contribute to hot workability.

The elements present in this composition are balanced to provide an austenitic microstructure in which the strengthening elements niobium, titanium and aluminum react during appropriate heat treatment with nickel to form one or more strengthening phases in the form of an intragranular precipitate by age or precipitation hardening. The composition of those phases is generalized as $Ni_3(Nb,Ti,Al)$ and may include gamma prime and/or gamma double prime.

The age-hardenable corrosion resistant nickel-base chromium, molybdenum, niobium, titanium and aluminum alloy of the present invention is readily fabricated into a wide variety of parts following practices utilized in connection with other nickel base alloys. It is well suited to be produced in the form of billets, bars, rod, strip and plate as well as a variety of semi-finished and finished articles for use where its outstanding combination of strength and corrosion resistance in the heat treated condition is desired without requiring working below the recrystallization temperature. Homogenization and hot working is carried out from a temperature of about 2050–2200 F. (about 1120–1200 C.). When required following hot working, solutioning and recrystallization is carried out by heating to a solution treating temperature of about 1800–2200 F. (about 980–1200 C.). An optimum solution treating temperature is 1900 F. (1038 C.) and preferably should be no higher than about 1950 F. (about 1065 C.) because higher temperature tends to reduce strength and pitting and crevice corrosion resistance, and to increase intergranular precipitation during the aging heat treatment. Lower solution treating temperatures than the recrystallization temperature are preferably not used to avoid an adverse effect on corrosion resistance and microstructure though higher strength may result. While care is to be exercised in selecting the solution and aging treating temperatures, the temperatures to be used for optimum results are readily determined. A single step age hardening heat treatment may be used if desired but to provide optimum strength and corrosion resistance a two-step aging treatment is preferred. The initial or primary aging treatment can be at about 1250 F. (677 C.) to 1450 F. (788 C.), preferably between about 1300 and 1400 F. (about 700–760 C.), e.g. 1350 F. (732 C.), followed by secondary aging at about 1100–1250 F. (about 590–675 C.). It is to be noted that in this composition, the use of higher primary aging temperatures result in increased strength but contributes to intergranular precipitation.

The examples set forth in Table III are exemplary of the present invention and in addition to the amounts indicated under each element contained from 0.001–0.006% boron. Other elements when present in more than what is considered a residual or incidental amount in keeping with good commercial practice are indicated in the footnote to the table.

TABLE III

| Ex. No. | C | Cr | Ni | Mo | Nb | Ti | Al | Fe | Hdnr. (a/o) |
|---|---|---|---|---|---|---|---|---|---|
| 1 | 0.016 | 16.40 | 55.04 | 11.33 | 3.03 | 1.25 | 0.27 | 12.38 | 4.1 |
| 2 | 0.016 | 19.00 | 55.22 | 8.79 | 3.03 | 1.28 | 0.26 | 12.04 | 4.1 |
| 3 | 0.014 | 18.96 | 54.68 | 8.86 | 3.06 | 1.25 | 0.54 | 11.77 | 4.7 |
| 4 | 0.017 | 16.09 | 58.94 | 11.71 | 3.04 | 1.23 | 0.27 | 8.07 | 4.1 |
| 5 | 0.016 | 16.36 | 63.19 | 11.85 | 3.11 | 1.22 | 0.27 | 4.13 | 4.1 |
| 6 | 0.018 | 16.40 | 66.47 | 12.12 | 3.06 | 1.31 | 0.24 | 0.21 | 4.1 |
| 7 | 0.016 | 18.93 | 63.87 | 11.92 | 3.17 | 1.37 | 0.24 | 0.33 | 4.3 |
| 8 | 0.018 | 19.02 | 63.23 | 9.03 | 3.87 | 1.71 | 0.28 | 3.04 | 5.2 |
| 9 | 0.013 | 18.79 | 62.92 | 8.11 | 3.08 | 1.25 | 0.25 | 3.21 | 4.1* |
| 10 | 0.014 | 19.00 | 59.10 | 9.07 | 3.11 | 1.19 | 0.28 | 7.84 | 4.1 |
| 11 | 0.014 | 18.97 | 63.30 | 9.16 | 3.07 | 1.23 | 0.28 | 4.07 | 4.1 |
| 12 | 0.015 | 21.57 | 63.40 | 9.04 | 3.04 | 1.31 | 0.26 | 1.30 | 4.1 |
| 13 | 0.015 | 21.82 | 59.37 | 9.04 | 3.15 | 1.24 | 0.24 | 5.09 | 4.1 |
| 14 | 0.015 | 21.97 | 64.02 | 9.05 | 3.09 | 1.26 | 0.26 | 0.24 | 4.1 |
| 15 | 0.018 | 15.84 | 54.51 | 9.13 | 3.01 | 1.23 | 0.27 | 15.21 | 4.0 |
| 16 | 0.014 | 16.40 | 58.70 | 9.10 | 3.05 | 1.25 | 0.21 | 11.20 | 4.0 |
| 17 | 0.018 | 18.81 | 60.07 | 8.95 | 2.54 | 1.46 | 0.24 | 7.37 | 4.0 |
| 18 | 0.013 | 18.78 | 60.21 | 8.91 | 3.03 | 1.26 | 0.23 | 7.11 | 4.0 |
| 19 | 0.010 | 19.03 | 60.25 | 8.90 | 3.52 | 0.96 | 0.23 | 7.05 | 3.9 |
| 20 | 0.010 | 18.88 | 60.32 | 8.94 | 3.02 | 1.66 | 0.24 | 6.79 | 4.5 |
| 21 | 0.010 | 18.90 | 60.24 | 8.91 | 3.52 | 1.39 | 0.24 | 6.57 | 4.5 |
| 22 | 0.011 | 18.97 | 60.45 | 8.93 | 3.53 | 1.39 | 0.11 | 6.78 | 4.2 |
| 23 | 0.010 | 18.99 | 60.57 | 8.94 | 4.00 | 1.15 | 0.26 | 6.41 | 4.6 |
| 24 | 0.012 | 18.99 | 60.33 | 8.93 | 4.43 | 0.84 | 0.29 | 6.16 | 4.5 |
| 25 | 0.010 | 18.95 | 58.83 | 8.83 | 3.09 | 1.21 | 0.22 | 8.37 | 4.0 |
| 26 | 0.030 | 18.99 | 59.14 | 8.94 | 3.05 | 1.28 | 0.22 | 8.51 | 4.0 |
| 27 | 0.055 | 18.99 | 59.01 | 8.89 | 3.11 | 1.22 | 0.25 | 8.19 | 4.1 |
| 28 | 0.012 | 23.50 | 58.95 | 6.59 | 3.08 | 1.25 | 0.24 | 6.50 | 4.0 |
| 29 | 0.011 | 20.48 | 59.07 | 7.04 | 3.12 | 1.24 | 0.25 | 8.63 | 4.1 |
| 30 | 0.011 | 23.51 | 58.97 | 7.29 | 3.12 | 1.26 | 0.24 | 5.49 | 4.1 |
| 31 | 0.014 | 19.02 | 59.17 | 7.52 | 3.08 | 1.20 | 0.25 | 9.50 | 4.0 |
| 32 | 0.012 | 21.97 | 59.04 | 7.93 | 3.10 | 1.28 | 0.24 | 6.25 | 4.1 |
| 33 | 0.013 | 20.52 | 59.15 | 8.15 | 3.07 | 1.26 | 0.23 | 7.59 | 4.0 |
| 34 | 0.010 | 17.63 | 59.33 | 8.94 | 3.10 | 1.26 | 0.23 | 9.40 | 4.1 |
| 35 | 0.014 | 19.01 | 57.13 | 8.97 | 3.14 | 1.28 | 0.26 | 10.33 | 4.2 |
| 36 | 0.011 | 20.27 | 59.07 | 8.87 | 3.06 | 1.27 | 0.24 | 7.04 | 4.1 |
| 37 | 0.012 | 19.25 | 59.01 | 10.57 | 3.06 | 1.28 | 0.21 | 6.72 | 4.0 |
| 38 | 0.011 | 20.47 | 58.91 | 10.61 | 3.03 | 1.26 | 0.21 | 5.31 | 4.0 |
| 39 | 0.011 | 20.50 | 62.96 | 10.51 | 3.05 | 1.27 | 0.20 | 1.41 | 4.0 |
| 40 | 0.012 | 17.59 | 59.28 | 11.92 | 3.02 | 1.23 | 0.23 | 6.42 | 4.0 |
| 41 | 0.013 | 19.06 | 55.12 | 8.92 | 3.07 | 1.23 | 0.25 | 10.24 | 4.0* |
| 42 | 0.012 | 18.98 | 55.15 | 8.91 | 3.10 | 1.21 | 0.25 | 9.38 | 4.0* |
| 43 | 0.011 | 19.08 | 55.13 | 8.93 | 3.13 | 1.24 | 0.22 | 10.13 | 4.0* |
| 44 | 0.014 | 18.93 | 58.80 | 8.98 | 3.07 | 1.21 | 0.18 | 7.15 | 3.9* |
| 45 | 0.012 | 19.03 | 60.06 | 9.04 | 3.05 | 0.90 | 0.24 | 7.75 | 3.6 |

TABLE III-continued

| Ex. No. | C | Cr | Ni | Mo | Nb | Ti | Al | Fe | Hdnr. (a/o) |
|---|---|---|---|---|---|---|---|---|---|
| 46 | 0.014 | 19.18 | 59.92 | 8.82 | 3.94 | 0.50 | 0.23 | 7.31 | 3.6 |
| 47 | 0.017 | 18.97 | 60.02 | 8.98 | 3.08 | 1.28 | 0.05 | 7.85 | 3.7 |
| 48 | 0.012 | 19.02 | 59.84 | 8.89 | 3.49 | 1.26 | 0.19 | 7.02 | 4.2 |
| 49 | 0.011 | 19.13 | 59.64 | 8.83 | 3.49 | 1.37 | 0.21 | 5.83 | 4.4* |
| 50 | 0.013 | 19.22 | 61.27 | 8.86 | 3.51 | 1.41 | 0.20 | 5.36 | 4.4 |
| 51 | 0.010 | 21.86 | 61.63 | 8.89 | 3.54 | 1.42 | 0.22 | 2.28 | 4.5 |
| 52 | 0.013 | 19.20 | 63.36 | 8.81 | 4.20 | 1.44 | 0.22 | 2.93 | 5.0 |

*The following additional quantities were present: 2.28% W Ex. 9, 1.42% Cu Ex. 41, 3.03% Cu Ex. 42, 1.83% Co Ex. 43, 1.90% Mn Ex. 44, 1.47% Cu Ex. 49.

Examples 1–52 were vacuum induction melted as small laboratory heats and, unless otherwise noted, contained <0.2% manganese, <0.2% silicon, <0.015% phosphorus, <0.010% sulfur, and <0.01% nitrogen. An addition of 0.05% magnesium was made to each to complete desulphurization and/or deoxidation before being cast as an ingot. The ingots were homogenized at 2185 F. (1195 C.) for an extended period (about 60–70 hours) and then forged from a starting temperature of about 2100 F. (about 1150 C.), with intermediate reheats as required, to bars 0.75 in×1.25 or 1.5 in (1.9×3.2 or 3.8 cm). Sections of forged bar from each example were then formed into 0.125 in (0.32 cm) thick strip.

Each heat (Ht.) listed in Table IIIA is outside the scope of the present invention and was prepared and processed as described in connection with Examples 1–52 and, in addition to the small amounts of incidental elements as described in connection with Table III, Heat 936 contained tungsten in the footnote to Table IIIA.

TABLE IIIA

| Ht. No. | C | Cr | Ni | Mo | Nb | Ti | Al | Fe | Hdnr. (a/o) |
|---|---|---|---|---|---|---|---|---|---|
| 317 | 0.022 | 18.84 | 59.27 | 4.64 | 3.17 | 1.28 | 0.24 | 11.39 | 4.1 |
| 318 | 0.017 | 16.00 | 57.74 | 5.84 | 3.06 | 1.28 | 0.25 | 15.21 | 4.1 |
| 321 | 0.016 | 21.80 | 59.33 | 5.85 | 3.08 | 1.28 | 0.25 | 7.52 | 4.1 |
| 322 | 0.015 | 21.82 | 52.14 | 6.04 | 3.15 | 1.24 | 0.25 | 14.71 | 4.1 |
| 324 | 0.010 | 19.00 | 56.59 | 8.83 | 0.02 | 2.75 | 0.33 | 12.12 | 4.1 |
| 348 | 0.050 | 19.07 | 52.22 | 3.03 | 5.12 | 1.02 | 0.59 | 18.27 | 5.8 |
| 349 | 0.046 | 21.87 | 61.84 | 8.98 | 3.78 | 0.21 | 0.23 | 2.54 | 3.2 |
| 394 | 0.015 | 16.00 | 63.01 | 12.05 | 0.08 | 3.52 | 0.24 | 4.94 | 4.9 |
| 401 | 0.018 | 19.13 | 63.19 | 9.00 | 0.07 | 3.00 | 0.24 | 5.25 | 4.3 |
| 402 | 0.013 | 21.99 | 63.33 | 8.83 | 0.06 | 3.52 | 0.17 | 1.99 | 4.8 |
| 406 | 0.017 | 15.85 | 55.29 | 6.01 | 3.03 | 1.26 | 0.23 | 18.24 | 4.0 |
| 407 | 0.017 | 18.69 | 54.66 | 6.01 | 3.05 | 1.28 | 0.24 | 15.00 | 4.1 |
| 408 | 0.015 | 18.97 | 58.67 | 6.07 | 3.07 | 1.23 | 0.23 | 11.06 | 4.0 |
| 409 | 0.015 | 18.74 | 62.76 | 6.09 | 3.06 | 1.26 | 0.20 | 7.23 | 4.0 |
| 412 | 0.016 | 21.74 | 55.00 | 4.57 | 3.04 | 1.27 | 0.25 | 13.69 | 4.1 |
| 413 | 0.014 | 21.55 | 59.06 | 4.52 | 3.12 | 1.28 | 0.26 | 9.80 | 4.2 |
| 414 | 0.015 | 24.96 | 58.75 | 4.48 | 3.01 | 1.33 | 0.22 | 6.88 | 4.1 |
| 415 | 0.017 | 21.99 | 54.86 | 6.09 | 3.11 | 1.35 | 0.22 | 12.17 | 4.1 |
| 422 | 0.013 | 21.53 | 63.05 | 6.07 | 3.11 | 1.27 | 0.24 | 4.29 | 4.1 |
| 423 | 0.008 | 21.98 | 63.06 | 5.93 | 0.03 | 3.57 | 0.24 | 5.06 | 5.0 |
| 424 | 0.017 | 24.93 | 62.96 | 6.20 | 2.96 | 1.36 | 0.25 | 1.36 | 4.1 |
| 587 | 0.011 | 19.11 | 63.48 | 8.85 | 4.35 | 1.71 | 0.25 | 2.32 | 5.5 |
| 588 | 0.012 | 19.17 | 63.56 | 8.87 | 4.85 | 1.40 | 0.24 | 2.05 | 5.4 |
| 589 | 0.012 | 18.70 | 59.72 | 9.00 | 0.35 | 2.98 | 0.70 | 7.44 | 5.5 |
| 590 | 0.010 | 18.79 | 59.62 | 8.96 | 0.31 | 2.46 | 1.08 | 7.72 | 5.6 |
| 910 | 0.011 | 23.21 | 59.03 | 8.88 | 3.14 | 1.26 | 0.24 | 4.10 | 4.1 |
| 914 | 0.011 | 20.53 | 58.91 | 11.83 | 3.06 | 1.26 | 0.21 | 3.81 | 4.0 |
| 918 | 0.015 | 18.94 | 60.00 | 9.02 | 3.49 | 0.53 | 0.23 | 7.76 | 3.4 |
| 931 | 0.029 | 21.49 | 61.77 | 8.66 | 4.08 | 0.40 | 0.31 | 3.14 | 3.8 |
| 936 | 0.011 | 19.00 | 58.92 | 6.32 | 3.08 | 1.26 | 0.26 | 8.14* | 4.1 |
| 967 | 0.012 | 21.95 | 58.76 | 10.48 | 3.08 | 1.27 | 0.22 | 4.49 | 4.0 |

*Additionally, Heat 936 contained 2.78% W.

Tensile and corrosion test specimens were prepared from bar and/or strip material of the examples and heats of Tables III and IIIA and were tested in the solution treated (recrystallized) plus age hardened condition unless otherwise stated. Room temperature tensile and hardness data are set forth in Tables IV and IVA. The 0.2% yield strength ("0.2% YS") is given as the average of two tests in "ksi" and "(MN/m$^2$)" as is also the ultimate tensile strength ("UTS"). The percent elongation in four diameters or widths depending on whether from bar or strip specimens is indicated as "El.(%)". The percent reduction in area is indicated as "RA(%)". The average room temperature hardness on the Rockwell C scale is indicated as "HRC". Whether the data was obtained from bar (B) or strip (S) specimens is indicated under "Bar/Strip". The following is a digest of the heat treatment (H.T.) designations used to identify how the individual test specimens were heat treated. The solution treatment at specific temperatures is assigned an identifying letter, e.g. 1800 F. for 1 hour is identified by "A" in the following table. The numbers used to identify specific aging treatments are also given in the following table where cooling in the furnace or oven at a rate of about 100 F° (55.6 C°)/hour is indicated by "FC", and cooling in air is indicated by "AC".

| | (°F.) Sol. Treat. | | Aging Treatment |
|---|---|---|---|
| A | 1800-1 h/AC | 1 | 1350 F-8h/FC-1150 F-8h/AC |
| B | 1900-1 h/AC | 2 | 1375 F-8h/FC-1150 F-8h/AC |
| C | 1950-1 h/AC | 3 | 1450 F-8h/FC-1150 F-8h/AC |
| D | 2000-1 h/AC | 4 | 1325 F-8h/FC-1150 F-8h/AC |
| E | 2050-½ h/AC | 5 | 1425 F-8h/AC |
| F | 2100-1 h/AC | 6 | 1400 F-8h/AC-1200 F-8h/AC |

TABLE IV

| Ex. No. | 0.2% YS ksi(MN/m$^2$) | UTS ksi(MN/m$^2$) | El. (%) | RA (%) | HRC | Bar/ Strip | H.T. |
|---|---|---|---|---|---|---|---|
| 1 | 119.4(823.2) | 170.8(1172.1) | 20.4 | 21.3 | 36 | S | E2 |
| 2 | — | — | — | — | 37.5 | B | B1 |
| | 125.8(867.4) | 183.4(1264.5) | 26.1 | 44.8 | 38.5 | S | B1 |
| 3 | 103.2(711.5) | 166.7(1149.4) | 36.7 | 50.0 | 35 | S | B2 |
| 4 | 121.8(839.8) | 188.0(1292.2) | 28.3 | — | 38 | S | B1 |
| | 115.8(798.4) | 171.7(1183.8) | 18.6 | — | 36 | S | E6 |
| 5 | 128.6(886.7) | 193.0(1330.7) | 28.2 | — | 37.5 | S | B1 |
| | 112.5(775.7) | 172.4(1188.7) | 22.2 | — | 35.5 | S | E6 |
| 6 | 138.5(954.9) | 198.9(1371.4) | 28.1 | — | 39 | S | B1 |
| | 113.3(781.2) | 180.6(1245.2) | 25.2 | — | 34.5 | S | E6 |
| 7 | 133.7(921.8) | 197.9(1364.5) | 28.6 | — | 39 | S | B1 |
| | 108.6(748.8) | 162.8(1122.5) | 24.7 | — | 33.5 | S | F6 |
| 8 | 137.9(950.8) | 197.7(1363.1) | 25.3 | — | 40.5 | S | B1 |
| 9 | 120.2(828.7) | 182.2(1256.2) | 31.0 | — | 36 | S | B1 |
| 10 | 116.4(802.5) | 176.2(1214.9) | 28.4 | — | 36 | S | B1 |
| 11 | 114.5(789.4) | 176.2(1214.9) | 31.1 | — | 35.5 | S | B1 |
| 12 | 120.2(828.7) | 180.8(1246.6) | 28.6 | — | 36 | S | B1 |
| 13 | 120.8(832.9) | 178.2(1228.6) | 29.4 | — | 37 | S | B1 |
| 14 | 120.8(832.9) | 179.7(1239.0) | 30.6 | — | 37 | S | B1 |
| 15 | 121.6(838.4) | 178.5(1230.7) | 26.2 | — | 37 | S | B1 |
| 16 | 120.7(832.2) | 178.7(1232.1) | 28.9 | — | 37.5 | S | B1 |
| 17 | 123.5(851.5) | 181.9(1254.2) | 32.2 | 59.8 | 36.5 | B | A1 |
| | 107.0(737.7) | 174.2(1201.1) | 37.3 | 50.9 | 33.5 | B | B1 |
| 18 | 137.7(949.4) | 192.5(1327.2) | 28.8 | 157.6 | 40 | B | A1 |
| | 131.8(908.7) | 190.9(1316.2) | 30.1 | 58.1 | 37 | B | B1 |
| 19 | 148.8(1025.9) | 197.3(1360.4) | 29.2 | 57.8 | 40 | B | A1 |
| | 130.9(902.5) | 184.5(1272.1) | 31.5 | 59.0 | 37 | B | B1 |
| 20 | 141.1(972.9) | 197.0(1298.3) | 30.7 | 57.4 | 40 | B | A1 |
| | 130.0(896.3) | 188.3(1298.3) | 31.5 | 53.9 | 38 | B | B1 |
| 21 | 155.7(1073.5) | 203.2(1401.0) | 24.3 | 51.0 | 42.3 | B | A1 |
| | 140.4(968.0) | 194.5(1341.0) | 27.2 | 56.1 | 41.8 | B | B1 |
| 22 | 168.4(1161.1) | 210.7(1452.7) | 23.3 | 44.0 | 43.8 | B | A1 |
| | 131.9(909.4) | 191.0(1316.9) | 31.8 | 52.2 | 40 | B | B1 |
| 23 | 161.9(1116.3) | 205.7(1418.3) | 24.1 | 52.0 | 42.8 | B | A1 |
| | 142.9(985.3) | 195.0(1344.5) | 28.4 | 52.0 | 41.8 | B | B1 |
| 24 | 167.4(1154.2) | 209.7(1441.0) | 21.4 | 39.4 | 44 | B | A1 |
| | 145.3(1001.8) | 196.1(1352.1) | 28.6 | 55.5 | 41.5 | B | B1 |
| 25 | 124.7(859.8) | 184.1(1269.3) | 33.2 | 56.4 | 36 | B | B1 |
| | 124.6(859.1) | 182.4(1257.6) | 34.0 | 54.5 | 36.5 | S | B1 |
| 26 | 124.3(857.0) | 185.7(1280.4) | 30.0 | 48.9 | 35.5 | B | B1 |
| | — | — | — | — | 35.5 | S | B1 |
| 27 | 99.5(686.0) | 146.8(1012.2) | 30.2 | 59.6 | 34 | B | B1 |
| | — | — | — | — | 35 | S | B1 |
| 36 | 123.4(850.8) | 181.8(1253.5) | 30.5 | 58.2 | 35.5 | B | B1 |
| | — | — | — | — | 36 | S | B1 |
| 38 | 126.0(868.7) | 186.5(1285.9) | 27.9 | 47.4 | 36 | B | B1 |
| | — | — | — | — | 38.5 | S | B1 |
| 40 | 148.2(1021.8) | 205.4(1416.2) | 24.9 | 37.4 | 40 | B | B1 |
| | — | — | — | — | 39 | S | B1 |
| 41 | 131.4(905.0) | 183.6(1265.9) | 29.0 | 41.4 | 36.5 | B | B1 |
| | — | — | — | — | 36.5 | S | B1 |
| 42 | 124.5(858.4) | 177.1(1221.1) | 31.7 | 45.5 | 35.8 | B | B1 |
| | — | — | — | — | 36 | S | B1 |
| 44 | 127.8(881.2) | 185.3(1277.6) | 27.8 | 49.1 | 34.5 | B | B1 |
| | — | — | — | — | 37 | S | B1 |

TABLE IV-continued

| | | | | | | | |
|---|---|---|---|---|---|---|---|
| 45 | 115.3(795.0) | 171.2(1174.9) | 32.6 | 60.0 | 34 | B | B1 |
| | 116.8(805.3) | 170.4(1174.9) | 34.8 | 57.0 | 34 | S | B1 |
| 46 | 124.5(858.4) | 176.0(1213.5) | 31.4 | 61.2 | 34 | B | B1 |
| | 124.0(855.0) | 174.7(1204.5) | 34.8 | 57.2 | 36.5 | S | B1 |
| 47 | 122.5(844.6) | 183.3(1263.8) | 30.0 | 58.0 | 35.5 | B | B1 |
| | 147.4(1016.3) | 195.9(1350.7) | 27.8 | 57.5 | — | B | B1 |
| | 120.4(830.1) | 179.7(1239.0) | 33.2 | 51.7 | 35 | S | A1 |
| 48 | 129.9(895.6) | 192.0(1323.8) | 34.1 | 56.9 | 37 | B | B1 |
| | 161.5(1113.5) | 206.6(1424.5) | 27.7 | 54.0 | — | B | A1 |
| | 130.4(899.1) | 186.0(1282.4) | 33.3 | 56.1 | 38.5 | S | B1 |
| | — | — | — | — | 40.5 | S | A1 |
| 49 | 130.6(900.5) | 190.6(1314.1) | 33.1 | 49.6 | 37.5 | B | B1 |
| | — | — | — | — | 39 | S | B1 |
| 50 | 128.7(887.4) | 190.6(1314.1) | 31.4 | 52.4 | 37.5 | B | B1 |
| | 137.7(949.4) | 193.2(1332.1) | 29.0 | 51.3 | 39.3 | S | B1 |
| 51 | 129.6(893.6) | 186.8(1287.9) | 25.4 | 51.5 | 37.5 | B | B1 |
| | — | — | — | — | 40 | S | B1 |
| 52 | 162.4(1119.7) | 212.4(1464.5) | 22.6 | 39.2 | 45 | B | B1 |
| | 152.3(1050.1) | 200.4(1381.7) | 26.9 | 47.9 | 42 | S | B1 |

In the case of Exs. 28–35, 37, 39, 43 the only mechanical property tested was hardness (heat treatment B1) with the following results. Bar or strip specimens are indicated by under "B/S".

| Ex. No. | HRC | B/S | Ex. No. | HRC | B/S | Ex. No. | HRC | B/S |
|---|---|---|---|---|---|---|---|---|
| 28 | 36.5 | B | 32 | 36.5 | B | 37 | 36 | B |
| | 36 | S | | 37 | S | | 37.5 | S |
| 29 | 36 | B | 33 | 35.8 | B | 39 | 37.5 | B |
| | 36 | S | | 35.5 | S | | 37.5 | S |
| 30 | 36 | B | 34 | 36 | B | 43 | 36.3 | B |
| | 37.5 | S | | 35.5 | S | | 37 | S |
| 31 | 35.5 | B | 35 | 37 | B | | | |
| | 36.5 | S | | 36 | S | | | |

TABLE IVA

| Ht. No. | 0.2% YS ksi(MN/m$^2$) | UTS ksi(MN/m$^2$) | El. (%) | RA (%) | HRC | Bar/ Strip | H.T. |
|---|---|---|---|---|---|---|---|
| 317 | 112.9(778.4) | 167.1(1152.1) | 27.2 | — | 34.5 | S | B1 |
| 318 | 117.5(810.1) | 173.4(1195.6) | 24.8 | 52.2 | 35 | S | B1 |
| 321 | 126.8(874.3) | 181.8(1253.5) | 25.8 | 47.4 | 38 | S | B1 |
| | 133.7(921.8) | 186.8(1287.9) | 25.5 | 51.9 | 40 | S | A1 |
| 322 | 123.8(853.6) | 177.0(1220.4) | 27.3 | 44.9 | 37 | S | B1 |
| 324 | 99.8(688.1) | 169.3(1167.3) | 32.3 | 33.2 | 34 | S | B2 |
| 348 | 135.8(936.3) | 186.3(1284.5) | 27.9 | 48.9 | 38.5 | B | B5 |
| | 155.3(1070.8) | 185.1(1276.2) | 23.2 | 48.1 | 41.5 | S | B4 |
| 349 | 144.8(998.4) | 160.6(1107.3) | 16.8 | 54.8 | 34.5 | S | * |
| | 167.8(1156.9) | 180.7(1245.9) | 9.4 | 54.5 | 37.5 | S | * |
| 394 | 102.1(704.0) | 153.4(1057.7) | 19.4 | — | 31.5 | S | E6 |
| 401 | 109.6(755.7) | 169.4(1168.0) | 32.0 | — | 34.5 | S | B6 |
| 402 | 108.2(746.0) | 166.1(1145.2) | 27.0 | — | 33.5 | S | E6 |
| 406 | 120.4(830.1) | 172.0(1185.9) | 26.4 | — | 36 | S | B1 |
| 407 | 121.3(836.3) | 173.4(1195.6) | 29.2 | — | 36.5 | S | B1 |
| 408 | 116.9(806.0) | 172.1(1186.6) | 27.5 | — | 36 | S | B1 |
| 409 | 112.8(777.7) | 169.4(1168.0) | 30.0 | — | 35 | S | B1 |
| 412 | 120.2(828.8) | 171.1(1179.7) | 28.5 | — | 37 | S | B1 |
| 413 | 120.0(827.4) | 172.3(1188.0) | 27.6 | — | 37.5 | S | B1 |
| 414 | 123.4(850.8) | 176.0(1213.5) | 27.4 | — | 37 | S | B1 |
| 415 | 119.8(826.0) | 175.0(1206.6) | 29.3 | — | 37 | S | B1 |
| 422 | 123.0(848.1) | 177.4(1223.1) | 28.3 | — | 37 | S | B1 |
| 423 | 111.3(767.4) | 167.9(1157.6) | 32.6 | — | 34 | S | E6 |
| 424 | 114.7(790.8) | 165.1(1138.3) | 30.3 | — | 35.3 | S | E6 |
| 587 | 160.4(1105.9) | 209.9(1447.2) | 26.7 | 47.5 | 43.5 | B | D2 |
| 588 | 168.8(1163.8) | 210.1(1448.6) | 23.3 | 45.5 | 44 | B | D2 |
| 589 | 117.4(809.4) | 187.1(1290.0) | 20.9 | 22.1 | 36.5 | B | D3 |
| | 120.4(830.1) | 181.3(1250.0) | 22.2 | 23.5 | 37 | S | C3 |
| 590 | 110.7(763.3) | 178.6(1231.4) | 24.9 | 25.5 | 33.5 | B | D3 |
| | 109.5(755.0) | 172.6(1190.0) | 25.0 | 23.1 | 35 | S | C3 |
| 910 | 135.9(937.0) | 189.6(1307.3) | 27.2 | 48.0 | 36.5 | B | B1 |
| | — | — | — | — | 36.5 | S | B1 |
| 914 | 163.8(1129.4) | 214.5(1478.9) | 19.8 | 32.9 | 43 | B | B1 |
| | 138.6(955.6) | 194.3(1339.7) | 27.6 | 36.3 | 39.5 | S | B1 |
| 918 | 102.6(707.4) | 157.4(1085.2) | 31.9 | 60.7 | 29 | B | B1 |
| | 94.4(650.9) | 150.3(1036.3) | 41.4 | 62.3 | 26.5 | S | B1 |

TABLE IVA-continued

| Ht. No. | 0.2% YS ksi(MN/m$^2$) | UTS ksi(MN/m$^2$) | El. (%) | RA (%) | HRC | Bar/ Strip | H.T. |
|---|---|---|---|---|---|---|---|
| 931 | 123.3(850.1) | 148.5(1023.9) | 37.2 | 52.1 | 31.5 | S | * |
| | 112.5(775.7) | 167.0(1151.4) | 38.3 | 54.3 | 34 | B | B1 |
| 936 | — | — | — | — | 35.5 | B | B1 |
| | — | — | — | — | 37.5 | S | B1 |
| 967 | 127.2(877.0) | 188.9(1302.4) | 28.2 | 40.3 | 38.5 | B | B1 |
| | — | — | — | — | 36 | S | B1 |

*Ht. 349 is representative of Type 625 alloy tested in the cold rolled condition, 24% reduction giving the lower and 31% reduction giving the higher strength. Ht. 931 was tested in both the cold rolled (21% reduction) condition (*) and in the B1 heat treated condition.

The alloy of the present invention in the solution treated and age hardened condition is brought to a high yield strength with a minimum hardener content (Nb+Ti+Al) of 3.5 a/o without requiring warm or cold working for that purpose. Yield strengths greater than 100 ksi (690 MN/m$^2$), that is at least about 105 ksi (about 724.9 MN/m$^2$) are consistently provided with hardener contents greater than 3.5 a/o with niobium≧3.0 w/o. As the weight percent niobium is reduced from 3.0 w/o to 2.0 w/o the minimum weight percent titanium is proportionately increased from about 0.8 w/o to about 2.0 w/o, that is, a reduction of a predetermined amount in the niobium content should be accompanied by 1.2 times that amount of an increase in the weight percent titanium present in the alloy. Preferably in making this and the following adjustments in niobium and titanium with regard to yield strength, only up to about 0.35 w/o (0.77 a/o) aluminum is present. When it is desired to provide consistently a minimum 0.2% yield strength of about 120 ksi (about 827 MN/m$^2$), niobium and titanium are adjusted proportionately in relation to each other so that as the percent by weight niobium is decreased from about 3.9 w/o to 3.0 w/o the minimum weight percent titanium is increased proportionately from 0.50 w/o to about 1.1 w/o, that is, the ratio of an increase in titanium to a decrease in niobium is equal to about ⅔. As the weight percent niobium is decreased from 3.0% to 2.75% the minimum weight percent titanium is increased proportionately from about 1.1% to 1.6%, that is, a ratio of an increase in titanium to the accompanying decrease in niobium of 2. And as the weight percent niobium is decreased from about 4.5 w/o to about 3.5 w/o the weight percent titanium is increased proportionately from 0.50 to 1.5 w/o, then a minimum 0.2% yield strength of about 140 ksi (about 965 MN/M$^2$) is attainable. When the carbon content exceeds about 0.03%, the effect of carbon on strength can be offset by increasing hardener content, particularly niobium, so as to compensate for the amount tied up by carbon and thereby rendered unavailable for the desired hardening reaction. Because carbon tends toward increased intergranular precipitation and an attendant reduction in corrosion resistance, the higher carbon contents contemplated herein, e.g. greater than 0.06% are to be avoided when its affect on corrosion resistance cannot be tolerated. Thus, Example 27 illustrates that with about 0.06% carbon the average yield strength was 99.5 (101.0 and 98.0) ksi. The strength of Ex. 27 can be increased by increasing the hardener content or by using a lower solution treating temperature, the Al heat treatment. To ensure attainment of the maximum attainable yield strength, processing of the material should be such as to provide a grain size in the age hardened material of about ASTM 5 or finer.

It is also to be noted that better toughness as measured by Charpy V-notch impact energy, ft-lb (J), is associated with lower amounts of grain boundary (intergranular) precipitation. As was seen hereinabove, the amounts of nickel, chromium and molybdenum are controlled in relation to each other and a minimum of about 57%, better yet 59%, nickel is preferred to avoid undesired phases. And also for better microstructure as represented by smaller amounts of grain boundary precipitation, molybdenum is preferably controlled in relation to the chromium content so that with 16.0–20.5% chromium, molybdenum does not exceed 10.0%. As chromium is increased from 20.5% to 24.0%, the maximum molybdenum is proportionately reduced from 10.0% with 20.5% chromium to 7% at 24.0% chromium. Ex. 25 specimens in the B1 heat treated condition had a Charpy V-notch impact strength (averages of two tests in each instance) of 97 ft-lb (131.5 J) and, when tested after being held at 1500 F. for two hours between solutioning and aging (exposed condition to simulate the effect of the slower rate at which larger sections cool down) had 68.5 ft-lb (92.9 J). Ex. 30 specimens had a V-notch Charpy impact strength of 75 ft-lb (101.7 J) as heat treated B1 and 47 ft-lb (63.7 J) exposed. Ex. 36 specimens when tested had an impact strength of 103 ft-lb (139.6 J) in the B1 condition and 58 ft-lb (78.6 J) in the exposed condition. Ex. 38 containing 20.47% Cr and 10.61% Mo had an impact strength of 45 ft-lb (61.0 J) as heat treated B1 and 30 ft-lb (40.7 J) exposed. To ensure a minimum V-notch Charpy impact strength of 40 ft-lb (54.2 J), a maximum of about 11% molybdenum is preferred with about 16–18% chromium. As chromium is increased from 18.0% to 22.0%, the maximum molybdenum is proportionately reduced from 11% to 9%, and as chromium is increased from 22.0% to 24%, % Cr+% Mo≦31. Ex. 40 specimens had a V-notch Charpy impact strength of 34.5 as heat treated B1 and 23.5 ft-lb (31.9 J) exposed. On the other hand, Heats 910, 914 and 967 (% Cr+% Mo>31) as B1 heat treated had impact strengths, respectively, of 66.5 ft-lb (90.2 J), 30.5 ft-lb (41.4 J) and 42 ft-lb (56.9 J), and in the exposed condition they had, respectively, 33.5 ft-lb (45.4 J), 17 ft-lb (23 J) and 24.5 ft-lb (33.2 J). The preferred composition of the present invention as set forth in Table II hereinabove is characterized by a minimum Charpy V-notch impact strength of 40 ft-lb (54.2 J).

Turning now to Tables V and VA, duplicate pitting and crevice corrosion test specimens were prepared and heat treated as indicated. Each specimen was machined to 1×2×⅛ in (2.5×5×0.3 cm) 120 grit surface, cleaned and weighed. The pitting temperature specimens were exposed to 150 ml of 6% $FeCl_3$ plus 1% HCl for a succession of 24 hour periods starting from room temperature with each period 2.5 C. higher than the preceding period. After each 24 hour exposure to the test medium, the specimens were removed, cleaned, reweighed and visually examined (up to 20×) for attack. In the case of pitted specimens the temperature was recorded. Unattacked specimens were returned to fresh solution for a further 24 hour exposure. The test was continued until a pitting temperature was determined or the solution began to boil whereupon the test was discontinued.

To each of the crevice corrosion specimens, after cleaning and weighing, an ASTM G-48 type crevice was attached. The specimens were then exposed to 150 ml of 6% $FeCl_3$ plus 1% HCl for 3 days at 40 C. or 55 C., as indicated. Then the specimens were removed, freed of the crevice forming attachments and then cleaned and weighed. The weight loss in mg/cm$^2$ was then calculated with the results indicated in Tables V and VA. While the data obtained from specimens exposed at 40 C. are averaged those obtained from the exposure at 55 C. were not averaged. In evaluating the 55 C. data only the larger weight loss (worst case) from each example or heat was used in determining the interaction of the significant elements with respect to resistance to pitting and crevice corrosion in this test. The worst case data from each set of duplicate test specimens was used because with the increase in temperature to 55 C. a large spread occurred with the duplicate test specimens of a given example or heat—large in that averages in this case would tend to be misleading.

TABLE V

| Ex. | | Pitting Temp. (°C.) | Crevice Corrosion Wt Loss (mg/cm$^2$) | | |
|---|---|---|---|---|---|
| No. | HT | (24 h Exp.) | (40 C/72 h) | Avg. | (55 C/72 h) |
| 1 | E2 | 48, 50.5 | 1.4, 4.6 | 3.0 | — |
| 2 | B1 | >101, >101 | <0.1, <0.1 | <0.1 | 8.2,10.9 |
| 4 | E6 | 46.5, 49 | 3.0, 5.0 | 4.0 | — |
| | B1 | 96, >98.5 | 0.6, 1.7 | 1.2 | 17.2,20.0 |
| 5 | E6 | 67, 71 | 4.5, 4.2 | 4.4 | — |
| | B1 | 42, 98.5 | 1.7, 1.1 | 1.4 | 21.1,17.9 |
| 6 | E6 | 83.5, 83.5 | 1.5, 0.3 | 0.9 | — |
| | B1 | >98.5, >98.5 | 0.3, 0.3 | 0.3 | 2.9,14.4 |
| 7 | F6 | 86, 92 | 0, 0 | 0 | — |
| | B1 | >98.5, >98.5 | 0, 0 | 0 | 0.0,0.1 |
| 8 | B1 | >101, >101 | 0.8, 0.9 | 0.9 | 2.1,0.7 |
| 9 | B1 | >101, >101 | 0.3, 0.6 | 0.5 | 3.6,13.3 |
| 10 | B1 | >101, >101 | 0.2, 0.4 | 0.3 | 1.1,1.1 |
| 11 | B1 | 90, >101 | 0.5, 1.0 | 0.8 | 3.3,0.9 |
| 12 | B1 | >101, >101 | 1.1, 1.1 | 1.1 | 8.0,2.8 |
| 13 | B1 | >101, >101 | <0.1, <0.1 | <0.1 | 6.7,3.5 |
| 14 | B1 | >101, >101 | 0.3, 0.3 | 0.3 | 10.4,2.0 |
| 15 | B1 | >101, 101 | 2.7 | 2.7 | 4.8,18.0 |
| 16 | B1 | 92, 97 | 0.5, 1.0 | 0.8 | 2.1,3.8 |
| 17 | B1 | >100, >100 | — | — | 7.7,11.2 |
| 18 | A1 | — | — | — | 12.8,8.1 |
| | B1 | >95, >95 | — | — | 2.7,3.6 |
| 19 | B1 | — | — | — | 1.4,0.9 |
| | B2 | — | — | — | 3.5 |
| 20 | B1 | >95, >95 | — | — | 0.7,1.8 |
| 21 | A1 | — | — | — | 4.0,13.6 |
| | B1 | >100 | — | — | 1.6,4.4 |
| 22 | A1 | — | — | — | 3.8,8.5 |
| | B1 | >95, >95 | — | — | 0.9,2.4 |
| 23 | B1 | — | — | — | 1.2,1.4 |
| 24 | A1 | — | — | — | 1.0,19.2 |
| | B1 | >100, >100 | — | — | 1.2,11.1 |
| 25 | B1 | >101, >101 | 0.0, 0.0 | 0.0 | 0.3,1.6 |
| 26 | B1 | >100, >100 | 0.1, 0.0 | 0.1 | 1.2,5.3 |
| 27 | B1 | >101, >101 | 0.0, 0.2 | 0.1 | 3.0,7.1 |
| 28 | B1 | 94, 100 | 2.5, 1.4 | 2.0 | 16.9,3.3 |
| 29 | B1 | 57.5, 90.5, 86 | 0.7, 3.0 | 1.9 | 2.6,9.9 |
| 30 | B1 | >101, >101 | 0.0, 0.0 | 0.0 | 2.9,6.5 |
| 31 | B1 | 88, 88 | 3.9, 1.3 | 2.6 | 12.1,6.7 |
| 32 | B1 | >101, >101 | 0.0, 2.2 | 1.1 | 1.5,4.9 |
| 33 | B1 | >101, >101 | 0.3, 0.2 | 0.3 | 2.0,4.9 |
| 34 | B1 | >101, >101 | 1.2, 0.1 | 0.7 | 6.2,1.1 |
| 35 | B1 | >100, >100 | 0.0, 0.0 | 0.0 | 12.1,0.8 |
| 36 | B1 | >101, 95 | 0.0, 0.0 | 0.0 | 4.3,4.5 |
| 37 | B1 | 101, >101 | 0.0, 0.0 | 0.0 | 14.9,15.7 |
| 38 | B1 | >101, >101 | 0.0, 0.0 | 0.0 | 15.1,16.9 |
| 39 | B1 | >101, >101 | 0.0, 0.0 | 0.0 | 5.4,0.2 |
| 40 | B1 | 96, 95 | 0.0, 0.0 | 0.0 | 11.7,12.2 |

TABLE V-continued

| Ex. | | Pitting Temp. (°C.) | Crevice Corrosion Wt Loss (mg/cm$^2$) | | |
|---|---|---|---|---|---|
| No. | HT | (24 h Exp.) | (40 C/72 h) | Avg. | (55 C/72 h) |
| 41 | B1 | 94, >100 | 0.0, 1.9 | 1.0 | 17.9,19.1 |
| 42 | B1 | 90, 77 | 3.7, 2.2 | 3.0 | 29.4,28.9 |
| 43 | B1 | 100, >100 | 0.0, 0.0 | 0.0 | 12.8,2.8 |
| 44 | B1 | 95, 92 | 0.3, 1.8 | 1.1 | 14.4,22.0 |
| 45 | B1 | 95, >101 | 0.0, 0.0 | 0.0 | 11.7,12.5 |
| 46 | B1 | >101, 81 | 0.1, 0.0 | 0.1 | 23.8,14.0 |
| 47 | B1 | >100, >100 | 0.0, 0.1 | 0.1 | 4.9,3.0 |
| 48 | B1 | 94, >100 | 0.4, 0.0 | 0.2 | 2.1,0.9 |
| | A1 | >100, >100 | 1.9, 0.0 | 1.0 | 5.4,1.3 |
| 49 | B1 | >100, >100 | 0.0, 0.0 | 0.0 | 3.0,11.8 |
| 50 | B1 | 100, >100 | 0.1, 0.2 | 0.0 | 7.9,7.9 |
| 51 | B1 | >100, >100 | 0.0, 0.0 | 0.0 | 0.5,5.3 |
| 52 | B1 | >100, >100 | 0.1, 0.0 | 0.1 | 2.5,1.0 |

*Exs. 17–24 exposed at temperature indicated for 72 h without interruption.

TABLE VA

| Ex. | | Pitting Temp. (°C.) | Crevice Corrosion Wt. Loss (mg/cm$^2$) | | |
|---|---|---|---|---|---|
| No. | HT | (24 h Exp.) | (40 C/72 h) | Avg. | (55 C/72 h) |
| 317 | B1 | 44.5, 36.5 | 36.7, 37.2 | 37.0 | — |
| 318 | B1 | 65, 68 | 14.5, 16.4 | 15.5 | — |
| 321 | B1 | 65, 78.5 | 2.6, 2.3 | 2.5 | 16.8, 15.9 |
| 322 | B1 | 76, 81 | 2.4, 0.5 | 1.5 | — |
| 324 | B2 | 45.5, 50.5 | 6.6, 8.6 | 7.6 | — |
| 348 | B4 | 60, 65 | 36.0, 37.6 | 36.8 | 43.2, 41.9 |
| 349 | *1 | >101, >101 | 0.0, 0.2 | 0.1 | 9.6, 11.1 |
| | *2 | >100, >100 | — | — | 3.1, 10.8 |
| 401 | B6 | 49, 41 | 8.0, 7.1 | 7.6 | — |
| 402 | E6 | 36.5, 44.5 | 2.1, 3.6 | 2.9 | |
| 406 | B1 | 64.5, 71 | 19.7, 17.9 | 18.8 | — |
| 407 | B1 | 70, 76 | 6.1, 5.3 | 5.7 | — |
| 408 | B1 | 67, 73 | 3.5, 6.7 | 5.1 | 34.6, 30.0 |
| 409 | B1 | 67, 67 | 6.0, 7.7 | 6.9 | — |
| 412 | B1 | 65, 67 | 12.0, 12.3 | 12.2 | — |
| 413 | B1 | 59, 61.5 | 12.5, 15.7 | 14.1 | — |
| 414 | B1 | 67, 67 | 6.3, 7.2 | 6.8 | — |
| 415 | B1 | 80.5, 80.5 | 1.2, 4.2 | 2.7 | — |
| 422 | B1 | 80.5, 80.5 | 3.8, 1.0 | 2.4 | — |
| 423 | E6 | 44.5, 48 | 9.5, 8.3 | 8.9 | — |
| 424 | E6 | 83, 86 | 4.5, 7.3 | 5.9 | — |
| | B1 | 82.5, 80 | 1.7, 2.7 | 2.2 | 16.4, 3.2 |
| 587 | C2 | >100, >100 | — | — | 0.9, 1.2 |
| 588 | C2 | >100, >100 | — | — | 2.7, 0.3 |
| 910 | B1 | >101, 95 | 0.0, 0.0 | 0.0 | 13.7, 0.0 |
| 914 | B1 | >101, >101 | 0.0, 0.0 | 0.0 | 0.0, 11.3 |
| 918 | B1 | 90.5, 88 | 0.0, 0.0 | 0.0 | 24.1, 46.2 |
| 931 | *3 | >100, >100 | 0.0, 0.1 | 0.1 | 11.7, 6.7 |
| 936 | B1 | 90, 100 | 0.4, 1.2 | 0.8 | 38.2, 2.2 |
| | B1 | — | — | — | 33.8, 31.4 |
| 967 | B1 | >100, >100 | 0.0, 0.0 | 0.0 | 0.0, 0.0 |

*1 Cold rolled (24% reduction)
*2 Cold rolled (31% reduction)
*3 Cold rolled (21% reduction)

From Tables V and VA it is seen that chromium, niobium, titanium, molybdenum and nickel work to improve resistance to pitting and crevice corrosion resistance. Molybdenum is about four times as effective as chromium (in weight percent) in improving pitting and crevice corrosion resistance when tested at 40 C. in 6% ferric chloride ($FeCl_3$) plus 1% hydrochloric acid (HCl). In accordance with the present invention, a preferred composition provides a higher level of resistance in $FeCl_3$—HCl, that is, an average weight loss of no more than 1 mg/cm$^2$ when tested with a standard crevice (ASTM G-48) at 40 C. for 72 hours. In this composition there is preferably a minimum of about 17% chromium and the percent chromium plus four times the percent molybdenum is not less than about 52%.

$$\% \text{ Cr}+4(\% \text{ Mo}) \geqq 52 \qquad \text{Eq. 2}$$

This preferred composition also consistently provides freedom from the onset of pitting below the temperature at which the test medium boils, about 100 C., however, no more than about 11% molybdenum should be used with 17% chromium. From the worst case data obtained with the crevice corrosion test specimens exposed at 55 C., it is apparent good pitting and crevice corrosion resistance is preferably maintained with a minimum of about 59% nickel and by limiting the molybdenum content to no more than about 10%. The molybdenum and chromium contents are also preferably balanced in relation to each other so that at about 16% chromium the molybdenum is about 8.5–10%. As the weight percent chromium is increased from 16.0% to 20.5%, the minimum weight percent of molybdenum preferred is proportionately reduced to 7.0% but the maximum remains at about 10%. As the weight percent chromium is increased from 20.5% to about 24%, the preferred weight percent molybdenum is about 7–10% but not greater than about [31–(% Cr)]. For best crevice corrosion resistance in $FeCl_3$—HCl at 55 C., with a chromium content of about 18.0% it is preferred to use a molybdenum content of about 8.5 to 9.7%. As the chromium weight percent is increased from 18.0% to 20.5% the preferred minimum weight percent molybdenum is proportionately reduced from 8.5% to 8.0% and the preferred maximum weight percent is proportionately reduced to 9.4%. Further, as the weight percent chromium is increased from 20.5% to a preferred maximum of about 22.0% the minimum weight percent molybdenum is proportionately reduced from 8.0 to 7.7% and the maximum weight percent molybdenum is preferably reduced so that with a chromium content of about 22.0%, the maximum molybdenum is about 8.2%. In this composition, a minimum of about 0.8% to 0.9% titanium is required to attain the outstanding crevice corrosion resistance at 55° C. For best crevice corrosion resistance in $FeCl_3$—HCl at 55 C., in addition to controlling the chromium and molybdenum a minimum of about 1.1% Ti and of about 2.75% Nb is preferred.

Room temperature sulfide stress cracking test specimens were prepared from strip which, after heat treatment had been heated at 550 F. (287.8 C.) for 30 days and air cooled to simulate deep well aging (well aged). Longitudinal U-bend test specimens 3⅞×⅜×⅛ in (9.8×1×0.3 cm) from well aged strip were machined to a 120 grit surface finish and bent in accordance with ASTM G-30 (FIG. 5) to a 1 in (2.54 cm) inside diameter. A steel bolt was attached to each leg of each U-bend specimen using nuts and washers at each end. As indicated hereinbelow, transverse specimens were also prepared and processed as described in connection with the U-bend test specimens except that the transverse specimens were about 1⅜ in (3.5 cm) long and while exposed to the test solution each specimen was anchored at its opposite ends in engagement with iron sleeves and bent to a predetermined deflection by a force applied midway between its ends. After cleaning the specimens were exposed to the solution specified in NACE Test Method TM-01-77 (approved Jul. 1, 1977). Each specimen was examined at 20× magnification for cracks after intervals of about 240, 504, 648, and 1000 hours. The time after which cracking was detected or "NC" for no cracks is indicated in Table VI and VIA under "NACE". The U-bend data is grouped as longitudinal specimens under "Long." and the transverse specimens under "Trans." in Tables VI and VIA. As is well known, "longitudinal" and "transverse" serve to identify the axis of the specimen in relation to the direction in which the parent material, from which the specimen was prepared, was worked.

Chloride stress corrosion cracking U-bend test specimens were machined from well aged strip as described for use in connection with the NACE test method, and then were bent to an inside diameter of ¾ in (1.9 cm). The U-bend specimens were cleaned, examined at 20× magnification for mechanical defects and then were exposed without iron contact to 45% $MgCl_2$, boiling at 155 C., according to ASTM G-36 using Allihn condensers. The specimens were examined at 20× magnification after intervals of about 1, 2, 4, 7, 14, 21, 28, 36, and 42 days (1000 h) except that after exposure for 1000 h to boiling 45% $MgCl_2$, all unfailed U-bend specimens of Examples 17–24 and Ht. Nos. 348, 349 and 587–590 were restressed and exposed for an additional 1000 h (2000 h total). The results of these tests are set forth in Tables VI and VIA.

TABLE VI

| Ex. | | NACE (Rm. Temp.) | | 45% $MgCl_2$(1) |
|---|---|---|---|---|
| No. | H.T. | Long. | Trans. | (155 C) |
| 1 | E2 | 648,648 | | 92, 92 |
| 2 | B1 | NC, NC | NC, NC | 1008, 504, 137, 92 |
| 4 | E6 | NC, 1000 | | 340, 340 |
| | B1 | NC, NC | 230, NC | NC, NC |
| 5 | E6 | 504, 240 | | 862, 670 |
| | B1 | NC, NC | | NC, NC |
| 6 | E6 | 240, 240 | | NC, NC |
| | B1 | NC, NC | | NC, NC |
| 7 | F6 | 240, 240 | | 862, 862 |
| | B1 | NC, NC | | NC, NC |
| 8 | B1 | NC, NC | 230, NC(3) | NC, NC |
| 9 | B1 | NC, NC | | NC, NC |
| 10 | B1 | NC, NC | NC, NC | NC, NC |
| 11 | B1 | NC, NC | NC, NC | NC, NC |
| 12 | A1 | NC, NC | | 48, NC |
| | B1 | NC, NC | | NC, NC |
| 13 | A1 | NC, NC | | NC, NC |
| | B1 | NC, NC | | NC, 844 |
| 14 | A1 | NC, NC | | NC, NC |
| | B1 | NC, NC | 230, 230 | 670, 862 |
| 15 | B1 | NC, NC | | NC, NC |
| 16 | B1 | NC, NC | | NC, NC |
| 17 | B1 | NC, NC | NC, NC | 2016, NC |
| 18 | A1 | NC, NC | NC, NC | NC, NC |
| | B1 | NC, NC | | NC, NC |
| 19 | B1 | NC, NC | NC, NC | 672, NC |
| | B2 | NC, NC | | NC, NC |
| 20 | B1 | NC, NC | NC, NC | 168, NC |
| 21 | A1 | NC, NC | | NC, 504 |
| | B1 | NC, NC | NC, 652 | 1168, NC |
| 22 | A1 | NC, NC | | –, 1336 |
| | B1 | NC, NC | NC, 628 | –, 1168 |
| 23 | B1 | NC, NC | NC, 67 | 504, 1504 |
| 24 | A1 | NC, NC | | 1168, 1168 |
| | B1 | NC, NC | NC, 67 | 1168, NC |
| 25 | B1 | | NC, NC | NC, 696 |
| 26 | B1 | — | — | NC, NC(2) |
| 27 | B1 | | NC, NC | 336, 168 |
| 28 | B1 | | NC, NC | 504, 504 |
| 29 | B1 | | NC, NC | NC, NC |
| 30 | B1 | | NC, NC | 1032, NC |
| 31 | B1 | | NC, NC | 168, 504 |
| 32 | B1 | | NC, NC | 168, 696 |
| 33 | B1 | | NC, NC | 168, 168 |
| 34 | B1 | | NC, NC | 1032, NC |
| 35 | B1 | — | — | 1008, NC |
| 36 | B1 | | NC, NC | NC, NC |
| 37 | B1 | | 489, NC | 504, 336 |
| 38 | B1 | | 67, NC | 1032, NC |
| 39 | B1 | — | — | 168, 168 |
| 40 | B1 | — | 230, 67 | 336, 336 |

TABLE VI-continued

| Ex. | | NACE (Rm. Temp.) | | 45% $MgCl_2$(1) |
|---|---|---|---|---|
| No. | H.T. | Long. | Trans. | (155 C) |
| 41 | B1 | — | — | NC, NC(2) |
| 42 | B1 | — | — | NC, NC |
| 43 | B1 | — | NC, NC | 336, 504 |
| 44 | B1 | — | NC, NC | 504, NC |
| 45 | B1 | — | — | NC, NC(2) |
| 46 | B1 | — | NC, NC | NC, NC |
| 47 | B1 | — | — | NC, NC |
| 48 | B1 | — | 628, 628 | NC, NC |
| | A1 | — | NC, 504 | |
| 49 | B1 | — | NC, 489 | NC, NC |
| 50 | B1 | — | NC, NC | NC, NC |
| 51 | B1 | — | — | NC, NC |
| 52 | B1 | — | 67, 67 | 168, NC |

(1) Exs. exposed for up to 1000 h except Ex. Nos. 17–24 exposed for up to 2000 h.
(2) Suspicious area found but examination up to 500 × could not confirm presence or absence of cracks.
(3) The 2nd specimen of Ex. 8 (Trans.) was discontinued at 230 h because of equipment failure, no cracks were found.
NC = No cracking observed.

TABLE VIA

| Ht. | | NACE (Rm. Temp.) | | 45% $MgCl_2$) |
|---|---|---|---|---|
| No. | H.T. | Long | Trans. | (155 C) |
| 317 | B1 | NC, NC | | NC, NC |
| 318 | B1 | NC ,NC | | NC, NC |
| 321 | B1 | NC, NC | NC, NC | NC, NC |
| 322 | B1 | NC, NC | | 306, 355 |
| 324 | B2 | NC, NC | | NC, NC |
| 348 | B5 | NC, NC | NC, NC | 168, NC |
| | B4 | NC, NC | NC, NC | 48, 336 |
| 349 | (1) | NC, NC | | NC, NC |
| | (1) | NC, NC | NC, NC | NC, NC |
| 394 | E6 | 240, 240 | | 334, 162 |
| 401 | B6 | NC, NC | | NC, NC |
| 402 | E6 | 240, 1000 | | 862, 862 |
| 406 | B1 | NC, NC | | NC, NC |
| 407 | B1 | NC, NC | | NC, 676 |
| 408 | B1 | NC, NC | NC, NC | NC, NC |
| 409 | B1 | NC, NC | | NC, NC |
| 412 | B1 | NC, NC | | NC, NC |
| 413 | B1 | NC, NC | | NC, NC |
| 414 | B1 | NC, NC | | NC, NC |
| 415 | B1 | NC, NC | | NC, 168 |
| 422 | B1 | NC, NC | | NC, NC |
| 423 | E6 | 504, 240 | | NC, NC |
| 424 | E6 | NC, NC | | NC, 862 |
| | B1 | NC, NC | | NC, 168(2) |
| 587 | C2 | NC, 570 | 67, 230 | NC, NC |
| 588 | C2 | 240, 240 | | 336, 336 |
| 589 | C3 | NC, NC | | NC, NC |
| 590 | C3 | NC, NC | | 336, 336 |
| 910 | B1 | | 67, 67 | 336, NC |
| 914 | B1 | | | 504, 504 |
| 931 | (3) | | NC, NC | NC, NC |
| 967 | B1 | | 67, 67 | NC, NC(2) |

(1) Cold rolled to 24% and 31% reductions respectively.
(2) Suspicious area found but examination up to 500 × could not confirm presence or absence of cracks.

The NACE TM-01-77 test data in Tables VI and VIA show that the present composition is resistant to sulfide stress-cracking at room temperature. For best results, the highest levels of molybdenum, niobium and titanium should be avoided. In this regard, 24% chromium is used with 7% molybdenum. As the amount of chromium is decreased from 23%, the maximum amount of molybdenum can be increased from 8%, with the ratio of the reduction in the chromium weight percent to the increase in the tolerable molybdenum weight percent being equal to about 2. For example, a decrease in chromium content from about 22% to 20% results in an increase from about 8.5% to about 9.5% in the maximum amount of molybdenum that is preferably used when optimum resistance to sulfide stress-cracking is desired. Also indicated is a reduction to about 16% chromium when the molybdenum content is at about 11.5%. While aluminum is held to its preferred range for this purpose, the amount of niobium and titanium should be carefully controlled. With about 4.5% niobium present, titanium should not be greater than about 0.50%. As the weight percent niobium is reduced from 4.5% to about 3.0%, the maximum amount of titanium present can be proportionately increased to about 2.0%. Preferably, the maximum weight percent of niobium is 4.25% with which no more than about 0.50% titanium is used. As niobium is reduced from 4.25% to 3.0%, the maximum weight percent titanium is proportionately increased from about 0.50% to about 1.75%. Thus, the ratio of an increase in the weight percent of titanium to the accompanying decrease in niobium is 1.0 in both these instances.

The present alloy and age hardened products made therefrom have good resistance to chloride stress-cracking as demonstrated by exposure to the severe environment of boiling 45% $MgCl_2$. With nickel below about 60%, the lower chromium and molybdenum contents provide better results. Preferably, with a hardener content of about 4.0 a/o at least about 60% nickel should be present. And as the hardener content is increased above 4.0 a/o or decreased, the minimum nickel to be present is correspondingly increased or decreased above or below 60% with the amount of the change in nickel content being three times the change in hardener content. Thus, for an increase or decrease in the hardener content of 0.5 a/o the nickel content should be correspondingly increased or decreased by 1.5 a/o. In this regard, it should also be noted that copper also contributes to stress-cracking resistance in boiling $MgCl_2$ and for this purpose it is desirable to include up to about 3% copper to compensate for lower nickel than about 60% or when the hardener content is greater than 4.0 a/o. Up to about 2.0% copper is effectively used in compositions containing 60% nickel and above.

The combined effect of chloride, hydrogen sulfide and sulfur at elevated temperatures and pressure was determined in autoclave tests (elsewhere herein referred to as the autoclave test) at 400 F. (204 C.), 450 F. (232 C.) and 500 F. (260 C.) as a simulation of severe sour well environments. Duplicate U-bend specimens were prepared from strip which had been heated at 550 F. (287.8 C.) for 30 days (then air cooled) to simulate deep well aging. The U-bend test specimens were 3⅞×⅜× 0.100–0.125 in (9.8×0.95×0.254–0.318 cm) with 17/64 in (0.67 cm) diameter holes adjacent to each end. The specimens were ground to 120 grit finish, bent to 1 in (2.54 cm) inside diameter and were stressed. In Tables VII–IX, the number of hours of exposure following which the specimen showed a stress crack or NC for no crack is given. The examples of the present invention and of the heats in Tables VII–IX were exposed to saturated (25%) sodium chloride, 0.5 g/l elemental sulfur and 1300–1440 psig partial pressure of hydrogen sulfide test medium under three different conditions. As indicated in Table VII, the examples and heats there listed were tested for 648 h at 400 F. (204.4 C.) made up of two 160 h periods and one period of 328 h and if no cracks were observed the test was continued for 328 h at 450 F. Specimens from some of the examples and heats were tested for one 328 h period at 450 F. followed by two 328 h periods at 500 F. (260 C.). In Table VIII the specimens listed were tested for one 328 h period at 450 F. and one 328 h period at 500 F. The data set forth in Table IX was obtained from specimens tested for 328 h at 450 F. plus two periods each of 328 h at 500 F. It should also be noted here that $CO_2$ was not required to obtain a low pH and elemental sulfur was included in the test environment to increase the severity of the environment commensurate with such a highly alloyed material as the present composition.

TABLE VII

| Ex. No. | H.T. | 2 × 160 h + 328 h @ 400 F. + 328 h @ 450 F. | 328 h @ 450 F. + 2 × 328 h @ 500 F. |
|---|---|---|---|
| 1 | E2 | NC, NC, NC | — |
| 2 | B1 | NC, NC, NC | 984, 984 |
| 4 | E6 | NC, NC, NC, NC | 656, 984 |
| | B1 | — | 984, 984 |
| 5 | E6 | NC, NC, NC | — |
| 6 | E6 | NC, NC, NC | — |
| | B1 | — | 656, 656 |
| 7 | F6 | NC, NC, NC | — |
| | B1 | — | NC, NC |
| 8 | B1 | NC, NC, NC | 656 |
| 9 | B1 | NC, NC, NC | — |
| 10 | B1 | NC, NC, NC | 656, 984 |
| 11 | B1 | NC, NC, NC | 984, 984 |
| 12 | B1 | NC, NC, NC | — |
| 13 | B1 | NC, NC, NC | NC, NC |
| 14 | B1 | NC, NC, NC | NC, NC |
| | A1 | — | 656, 984 |
| 15 | B1 | NC, NC, NC | — |
| 16 | B1 | NC, NC, NC | 984, 984 |
| Ht. No. | | | |
| 317 | B1 | 976, 976, NC | — |
| 318 | B1 | 976, 976, 976 | — |
| 321 | B1 | NC, NC, NC | 328, 656 |
| 322 | B1 | NC, NC, NC | — |
| 324 | B2 | 976, NC, NC | — |
| 348 | B5 | — | 328, 328, 328, 328 |
| | B4 | 160, 160, 160 | 328, — |
| 349 | * | NC, NC, NC | NC, — |
| | * | — | 328, 656, 656 |
| 394 | E6 | 160, 976, 976, NC | — |
| 401 | B6 | NC, NC, NC, NC | — |
| 402 | E6 | NC, NC, NC, NC | — |
| 406 | B1 | 320, 320, 976 | — |
| 407 | B1 | 976, NC, NC | — |
| 408 | B1 | 976, NC, NC | — |
| 409 | B1 | NC, NC, NC | — |
| 412 | B1 | 160, 648, 976 | — |
| 413 | B1 | 648, 976, 976 | — |
| 414 | B1 | 648, 648, 976 | — |
| 415 | B1 | 976, NC, NC | — |
| 422 | B1 | 976, NC, NC | — |
| 423 | E6 | 976, 976, NC, NC | — |
| 424 | E6 | NC, NC, NC | — |
| | B1 | — | 656, NC |

*Cold rolled to 24% and 31% reduction, respectively.

TABLE VIII

| | 328 @ 450 F. + 328 h @ 500 F. | | | | |
|---|---|---|---|---|---|
| Ex. No. | H.T. | | Ht. No. | H.T. | |
| 18 | A1 | NC, NC | 587 | C2 | 328, 328 |
| | B1 | NC, NC | 588 | C2 | 328, 328 |
| 19 | B1 | NC, NC | 589 | C3 | 328, 328 |
| 21 | A1 | NC, NC | | | |
| | B1 | NC, 656 | | | |
| 22 | A1 | NC, NC | | | |
| | B1 | NC, NC | | | |

TABLE VIII-continued

| | 328 @ 450 F. + 328 h @ 500 F. | | | |
|---|---|---|---|---|
| Ex. No. | H.T. | | Ht. No. | H.T. |
| 23 | B1 | NC, NC | | |
| 24 | A1 | NC, NC | | |
| | B1 | NC, 656 | | |

TABLE IX

| | 328 h @ 450 F. + 2 × 328 h @ 500 F. | | | | |
|---|---|---|---|---|---|
| | H.T. | | Ex. No. | H.T. | |
| Ex. No. | | | | | |
| 25 | B1 | 984, 984 | 38 | B1 | NC, NC |
| | B1 | NC, 984 | 39 | B1 | NC, NC |
| 26 | B1 | 984, 984 | 40 | B1 | NC, 984 |
| 27 | B1 | 984, 984 | 42 | B1 | NC, NC |
| 28 | B1 | 984, NC | 44 | B1 | NC, NC |
| 29 | B1 | 656, 656 | 46 | B1 | 656, 984 |
| 30 | B1 | NC, NC | 48 | B1 | NC, NC |
| 31 | B1 | 656, 984 | | A1 | NC, NC |
| 32 | B1 | NC, NC | 49 | B1 | NC, 984 |
| 33 | B1 | 984, NC | 50 | B1 | 656, 984 |
| 36 | B1 | NC, 984 | 51 | B1 | NC, NC |
| 37 | B1 | 984, 984 | 52 | B1 | 984, 984 |
| Ht. No. | | | | | |
| 910 | B1 | NC, 984 | | | |
| 914 | B1 | NC, NC | | | |
| 931 | B1 | 984, 984 | | | |
| 936 | B1 | NC, 984 | | | |
| 967 | B1 | NC, NC | | | |

*Cold rolled to 21% reduction.

The autoclave test data demonstrate the outstanding resistance to corrosion and stress cracking under extremely severe conditions. Analysis of the data shows that in this composition molybdenum in weight percent is about four times as effective as chromium in improving resistance to stress cracking as measured in the autoclave test in the 400–450 F. temperature range. For best resistance to cracking in the 400–450 F. range, the percent chromium plus four times the percent molybdenum should not be less than about 47%, that is, $$\%\ Cr+4(\%\ Mo)\geqq 47\% \qquad \text{Eq. 3}$$

For best resistance to cracking in the 450–500 F. range, the percent chromium plus four times the percent molybdenum should not be less than about 49.5%, that is, $$\%\ Cr+4(\%\ Mo)\geqq 49.5\% \qquad \text{Eq. 4}$$

To optimize the alloy for resistance to cracking at 500 F., the percent chromium plus the percent molybdenum should not be less than 30%, that is, $$\%\ Cr+\%\ Mo\geqq 30\% \qquad \text{Eq. 5}$$

And for best resistance to stress-cracking at 500 F. in the autoclave test the hardener content is preferably no greater than about 4.5 a/o. For exposures at temperatures below 500 F. a hardener content up to about 5 a/o gives good resistance to stress-cracking. When adjusting hardener content for this purpose, aluminum is preferably no more than 0.35% (no more than 0.77 a/o) to maximize strength. Copper also contributes to improved resistance to stress cracking in the autoclave test and for this purpose up to 3% can be used. As hardener content is increased above 4.0 a/o, copper preferably up to 2.0% is used effectively in improving resistance to stress cracking in the autoclave test.

To further exemplify the present invention, Example 53 was prepared using a double melting practice as a heat weighing about 10,000 pounds (4,545.5 kg) and forged to 4 in (10.16 cm) round bar which was heat treated. The composition of Example 53 is set forth in Table X. The composition of Heat A, representative of commercial Type 625 alloy (also about a 10,000 lb heat) is also given in Table X.

TABLE X

| | Ex. 53 | Ht. A |
|---|---|---|
| C | 0.021 | 0.047 |
| Mn | 0.03 | 0.09 |
| Si | 0.08 | 0.12 |
| Cr | 19.85 | 22.10 |
| Ni | 61.73 | 61.57 |
| Mo | 8.81 | 8.79 |
| Ti | 1.27 | 0.27 |
| Al | 0.16 | 0.28 |
| Nb | 3.11 | 3.91 |
| B | 0.0037 | — |
| Fe | 4.92 | 2.84 |

Each contained less than 0.01% phosphorus and less than 0.01% sulfur. Though not indicated, Heat A also contained about 0.004% boron.

Standard room temperature threaded tensile test specimens cut from transverse sections of the Ex. 53 4 in bar material (B1 heat treated except for water quenching from the solution temperature) were prepared. Transverse tensile test specimens were also formed from forged and heat treated 5½ in (14.0 cm) round bar of Heat A. The tensile test data is set forth in Table XI and heat treated hardnesses are also given.

TABLE XI

| Ex./ Ht. No. | 0.2% YS ksi(MN/m²) | UTS ksi(MN/m²) | El. (4D) (%) | RA (%) | HRB/C | H.T. |
|---|---|---|---|---|---|---|
| 53 (1) | 119.5(823.9) | 175.6(1210.7) | 33.2 | 44.8 | C34 | B1 (2) |
| 53 (1) | 127.9(882.9) | 178.2(1228.3) | 30.8 | 42.8 | C35.5 | B2 (2) |
| A | 73.1(504.0) | 136.1(938.4) | 32.8 | 33.5 | B97 | B1 |
| A | 77.2(532.3) | 138.8(957.0) | 33.0 | 37.6 | B98 | A1 |

(1) Average of two tests.
(2) Water quenched after Sol. Treat.

Comparison of the data in Table XI clearly demonstrates that Type 625 alloy does not respond to practical age hardening treatment. Known alloys as well as that of the present invention and Type 625 may show higher strength when processing includes warm working. Unless cold worked, the strength of Type 625 alloy is far below that of the alloy of the present invention.

The alloy of the present invention by its unusual combination of strength and corrosion resistance properties is well suited for a wide variety of uses in the chemical, petroleum and nuclear industries. The alloy lends itself to the production of a large variety of sizes and shapes. Intermediate products in any desired form such as billets, bars, strip and sheet as well as powder metallurgy products can be provided from which an even wider range of finished products can be made. The compositions set forth herein are advantageously used to provide parts for use in the exploration for, and exploitation of, petroleum products such as those intended for exposure under stress and/or under elevated temperatures. For example to enumerate a few, such parts include subsurface safety valves, hangers, valve and packer components, and other parts used above or below ground.

While the present invention has been described in connection with exemplary embodiments thereof, it is recognized that further modifications are possible within the scope of the invention claimed. For example, when the smaller amounts of aluminum contemplated herein, that is less than about 0.35% aluminum, are reduced to less than 0.1% and are replaced by an equivalent atomic percent of titanium and/or niobium added to attain or maintain a minimum yield strength of about 105 ksi, such replacement may result in several tenths of a percent (atomic) less total hardener than if the aluminum content had not been reduced. This may result because the added amount of titanium and/or niobium causes a greater increase in strength than the amount, if any, the strength of the composition is reduced by the decrease in aluminum. It is, therefore, intended to include as little as 3.0 a/o hardener content when all or substantially all of the aluminum contemplated herein is replaced by titanium and/or niobium.

The terms and expressions which have been employed are used as terms of description and not of limitation. There is no intention in the use of such terms and expressions to exclude any equivalents of the features shown and described or portions thereof.

What is claimed is:

1. An age hardenable nickel base chromium, molybdenum, alloy which when solution treated and age hardened, has a 0.2% yield strength greater than 100 ksi combined with resistance to pitting and crevice corrosion and to stress corrosion cracking in chloride and sulfide environments at elevated temperatures up to about 500° F. without requiring working below its recrystallization temperature, said alloy in weight percent consisting essentially of about

| | (w/o) |
|---|---|
| Carbon | 0.1 Max. |
| Manganese | 5 Max. |
| Silicon | 1 Max. |
| Phosphorus | 0.03 Max. |
| Sulfur | 0.03 Max. |
| Chromium | 16–24 |
| Molybdenum | 7–12 |
| Tungsten | 4 Max. |
| Niobium | 2–6 |
| Titanium | 0.50–2.5 |
| Aluminum | Trace–1 |
| Boron | 0.02 Max. |
| Zirconium | 0.50 Max. |
| Cobalt | 5 Max. |
| Copper | 0–3 |
| Nitrogen | 0–04 Max. |
| Iron | 20 Max. |

the balance being at least about 57% nickel, the sum of the percent chromium and molybdenum being not greater than 31, and the sum of the percent niobium, titanium and aluminum being such that the total atomic percent thereof is about 3.5 a/o to 5 a/o when calculated as 0.64 (w/o Nb)+1.24 (w/o Ti)+2.20 (w/o Al).

2. The alloy as set forth in claim 1 containing about

| | (w/o) |
|---|---|
| Carbon | 0.03 Max. |
| Manganese | 2 Max. |
| Silicon | 0.5 Max. |
| Phosphorus | 0.015 Max. |
| Sulfur | 0.010 Max. |
| Chromium | 18–22 |
| Molybdenum | 7.5–11 |
| Niobium | 2.75–4.25 |
| Titanium | 0.75–1.5 |
| Aluminum | 0.05–0.35 |
| Boron | 0.001–0.006 |
| Zirconium | 0.08 Max. |
| Copper | 0.5 Max. |
| Nitrogen | 0.01 Max. |
| Iron | 2–14 |

and at least about 59% nickel.

3. The alloy as set forth in claim 1 containing about 0.06% Max. carbon, 2% Max. manganese and 0.5% Max. silicon.

4. The alloy as set forth in claim 3 containing about 0.5% Max manganese and about 0.2% Max. silicon and 14% Max. iron.

5. The alloy as set forth in claim 4 containing at least about 60% nickel.

6. The alloy as set forth in claim 4 containing about 0.03% Max. carbon and 0.2% Max. manganese.

7. The alloy as set forth in claim 6 containing about 0.01% Max. carbon and about 0.01% Max. nitrogen.

8. The alloy as set forth in claims 1–6 or 7 containing no more than about 11% molybdenum, the weight percent chromium and molybdenum being balanced so that with about 16.0% chromium there is about 7.5–11.0% molybdenum, and as chromium increases from 16.0% to 19.0% the minimum amount of molybdenum decreases to 7.0%.

9. The alloy as set forth in claim 8 containing a maximum of about 0.35% aluminum.

10. The alloy as set forth in claims 1–6 or 7 containing no more than about 10% molybdenum, in which the weight percent chromium and molybdenum are balanced so that with about 16% chromium molybdenum is about 8.5–10%, as the weight percent chromium is increased from 16.0% to 20.5% the minimum weight percent molybdenum is proportionately reduced to 7.0%, as the weight percent chromium is increased from 20.5% to about 24% the minimum weight percent molybdenum remains about 7% and the sum of the weight percent chromium and molybdenum is not greater than 31.

11. The alloy as set forth in claim 10 containing a minimum of about 0.9% titanium.

12. The alloy as set forth in claim 4 containing a minimum of about 17.0% chromium and in which % Cr+4(% Mo)≧52%.

13. The alloy as set forth in claim 11 containing a maximum of about 0.35% aluminum.

14. The alloy as set forth in claim 10 containing a minimum of about 2.75% niobium and a minimum of about 1.1% titanium.

15. The alloy as set forth in claim 1–6 or 7 in which the weight percent chromium and molybdenum are balanced so that with 25% chromium there is 7% molybdenum, as the weight percent chromium is reduced from 23% the maximum weight percent molybdenum is increased from 8% with the ratio of the reduction in weight percent chromium to the increase in the maximum weight percent molybdenum being equal to about 2.

16. The alloy as set forth in claim 15 containing 3.0–4.5% niobium, 0.50–2.0% titanium, the weight percent titanium and niobium being balanced so that with 4.5% niobium there is no more than 0.50% titanium, and as the maximum weight percent niobium is reduced from 4.5% to 3.0% the maximum weight percent titanium is increased to about 2.0%.

17. The alloy as set forth in claim 15 containing 3.0–4.25% niobium, 0.50–1.75% titanium, the weight percent niobium and titanium being balanced so that with 4.25% niobium there is a maximum of 0.50% titanium, and as the weight percent niobium is decreased from 4.25% to 3.0% the maximum titanium is proportionately increased from 0.50% to 1.75%.

18. The alloy as set forth in claim 1 in which the weight percent chromium and molybdenum are balanced so that with about 16.0% chromium there is about 7.5% molybdenum, and as chromium increases from 16.0% to 19.0% the minimum amount of molybdenum decreases to 7.0%.

19. The alloy as set forth in claim 1 in which the weight percent chromium and molybdenum are balanced so that with 16% chromium there is a minimum of 8.5% molybdenum, as the weight percent chromium increases from 16.0% to 21.5% the minimum amount of molybdenum decreases from 8.5% to 7%, and containing no more than about 4.5 atomic percent of niobium plus titanium and aluminum.

20. The alloy as set forth in claim 1 in which niobium and titanium are balanced so that with about 3.9% niobium there is present a minimum of 0.50% titanium, as the weight percent niobium is decreased from about 3.9 w/o to 3.0 w/o the minimum amount of titanium is proportionately increased from 0.50 w/o to about 1.1 w/o, as the amount of niobium is decreased from 3.0 w/o to 2.75 w/o the minimum amount of titanium is increased proportionately from about 1.1 w/o to 1.6 w/o.

21. The alloy as set forth in claim 1 in which niobium and titanium are balanced so that with about 4.5 w/o niobium there is present a minimum of 0.50 w/o titanium, and as the amount of niobium present is decreased from 4.5 w/o to about 3.5 w/o the minimum amount of titanium present is increased proportionately from 0.50 w/o to about 1.5 w/o.

22. The alloy as set forth in claim 2 in which niobium and titanium are balanced so that with about 3.9% niobium there is present a minimum of 0.50% titanium, as the weight percent niobium is decreased from about 3.9 w/o to 3.0 w/o the minimum amount of titanium is proportionately increased from 0.50 w/o to about 1.1 w/o, as the amount of niobium is decreased from 3.0 w/o to 2.75 w/o the minimum amount of titanium is increased proportionately from about 1.1 w/o to 1.6 w/o.

23. The alloy as set forth in claim 2 in which niobium and titanium are balanced so that with about 4.25 w/o niobium there is present a minimum of 0.75 w/o titanium, and as the amount of niobium present is decreased from 4.25 w/o to about 3.5 w/o the minimum amount of titanium present is increased proportionately from 0.75 w/o to about 1.5 w/o.

24. An age hardened corrosion resistant article made from a nickel base chromium, molybdenum, alloy having in the solution treated and aged condition a minimum 0.2% yield strength greater than 100 ksi combined with resistance to pitting and crevice corrosion and to stress corrosion cracking in chloride and sulfide environments at elevated temperatures up to about 500° F. without requiring working below its recrystallization temperature, said alloy in weight percent consisting essentially of about

| | (w/o) |
|---|---|
| Carbon | 0.1 Max. |
| Manganese | 5 Max. |
| Silicon | 1 Max. |
| Phosphorus | 0.03 Max. |
| Sulfur | 0.03 Max. |
| Chromium | 16–24 |
| Molybdenum | 7–12 |
| Tungsten | 4 Max. |
| Niobium | 2–6 |
| Titanium | 0.50–2.5 |
| Aluminum | Trace–1 |
| Boron | 0.02 Max. |
| Zirconium | 0.50 Max. |
| Cobalt | 5 Max. |
| Copper | 0–3 |
| Nitrogen | 0.04 Max. |
| Iron | 20 Max. |

the balance being at least about 57% nickel, the sum of the percent chromium and molybdenum being not greater than 31, and the sum of the percent niobium, titanium and aluminum being such that the total atomic percent thereof is about 3.5 a/o to 5 a/o when calculated as 0.64(w/o Nb)+1.24(w/o Ti)+2.20(w/o Al).

25. The article set forth in claim 24 in which the weight percent chromium and molybdenum are balanced so that with about 16.0% chromium there is about 7.5% molybdenum, and as chromium increases from 16.0% to 19.0% the minimum amount of molybdenum decreases proportionately to 7.0%.

26. The article set forth in claim 24 in which the weight percent chromium and molybdenum are balanced so that with about 16% chromium molybdenum is about 8.5–10%, as the weight percent chromium is increased from 16.0% to 20.5% the minimum weight percent molybdenum is proportionately reduced to 7.0%, as the weight percent chromium is increased from 20.5% to about 24% the minimum weight percent molybdenum remains about 7% and the sum of the weight percent chromium and molybdenum is not greater than 31.

27. The article set forth in claim 24 in which the weight percent chromium and molybdenum are balanced so that with 24% chromium there is 7% molybdenum, as the weight percent chromium is reduced from 23% the maximum weight percent molybdenum is increased from 8% with the ratio of the reduction in weight percent chromium to the increase in the maximum weight percent molybdenum being equal to about 2, and the sum of the percent niobium, titanium and aluminum being such that the total atomic percent thereof is not greater than 4.5 a/o.

28. The article set forth in claim 24 having in the as-solution treated and aged condition a minimum 0.2% yield strength of at least 120 ksi combined with resistance to pitting and crevice corrosion and to stress corrosion cracking in chloride and sulfide environments at elevated temperature without requiring working below the recrystallization temperature, and made from the alloy consisting essentially by weight of about

| | (w/o) |
|---|---|
| Carbon | 0.03 Max. |
| Manganese | 2 Max. |
| Silicon | 0.5 Max. |
| Phosphorus | 0.015 Max. |
| Sulfur | 0.010 Max. |
| Chromium | 18–22 |
| Molybdenum | 7.5–11 |

-continued

| | (w/o) |
|---|---|
| Niobium | 2.75–4.25 |
| Titanium | 0.75–1.5 |
| Aluminum | 0.05–0.35 |
| Boron | 0.001–0.006 |
| Zirconium | 0.08 Max. |
| Copper | 0.5 Max. |
| Nitrogen | 0.01 Max. |
| Iron | 2–14 |

and at least about 59% nickel.

29. A nickel-base alloy characterized by workability and fabricability, and in the worked and aged conditions by high strength, good ductility and resistance to pitting, hydrogen embrittlement and stress corrosion cracking, said alloy in weight percent consisting essentially of about

| | |
|---|---|
| Carbon | 0.14 |
| Manganese | <0.2 |
| Silicon | <0.2 |
| Phosphorus | <0.015 |
| Sulfur | <0.010 |
| Chromium | 19.01 |
| Molybdenum | 8.97 |
| Niobium* | 3.14 |
| Titanium | 1.28 |
| Aluminum | 0.26 |
| Boron | 0.001–0.006 |
| Nitrogen | <0.01 |
| Iron | 10.33 |

*(Columbium)

the balance consisting essentially of about 57.13% nickel.

30. A nickel-base alloy characterized by workability and fabricability, and in the worked and aged conditions by high strength, good ductility and resistance to pitting, hydrogen embrittlement and stress corrosion cracking, said alloy in weight percent consisting essentially of about

| | |
|---|---|
| Carbon | 0.015 |
| Manganese | <0.2 |
| Silicon | <0.2 |
| Phosphorus | <0.015 |
| Sulfur | <0.010 |
| Chromium | 21.82 |
| Molybdenum | 9.04 |
| Niobium* | 3.15 |
| Titanium | 1.24 |
| Aluminum | 0.24 |
| Boron | 0.001–0.006 |
| Nitrogen | <0.01 |
| Iron | 5.09 |

*(Columbium)

the balance consisting essentially of about 59.37% nickel.

31. A nickel-base alloy characterized by workability and fabricability, and in the worked and aged conditions by high strength, good ductility and resistance to pitting, hydrogen embrittlement and stress corrosion cracking, said alloy in weight percent consisting essentially of about

| | |
|---|---|
| Carbon | 0.018 |
| Manganese | <0.2 |
| Silicon | <0.2 |
| Phosphorus | <0.015 |
| Sulfur | <0.010 |
| Chromium | 18.81 |
| Molybdenum | 8.95 |
| Niobium* | 2.54 |
| Titanium | 1.46 |

-continued

| | |
|---|---|
| Aluminum | 0.24 |
| Boron | 0.001–0.006 |
| Nitrogen | <0.01 |
| Iron | 7.37 |

*(Columbium)

the balance consisting essentially of about 60.07% nickel.

32. A nickel-base alloy characterized by workability and fabricability, and in the worked and aged conditions by high strength, good ductility and resistance to pitting, hydrogen embrittlement and stress corrosion cracking, said alloy in weight percent consisting essentially of about

| | |
|---|---|
| Carbon | 0.010 |
| Manganese | <0.2 |
| Silicon | <0.2 |
| Phosphorus | <0.015 |
| Sulfur | <0.010 |
| Chromium | 18.88 |
| Molybdenum | 8.94 |
| Niobium* | 3.02 |
| Titanium | 1.66 |

-continued

| | |
|---|---|
| Aluminum | 0.24 |
| Boron | 0.001–0.006 |
| Nitrogen | <0.01 |
| Iron | 6.79 |

*(Columbium)

the balance consisting essentially of about 60.32% nickel.

33. A nickel-base alloy characterized by workability and fabricability, and in the worked and aged conditions by high strength, good ductility and resistance to pitting, hydrogen embrittlement and stress corrosion cracking, said alloy in weight percent consisting essentially of about

| | |
|---|---|
| Chromium | 16–22 |
| Molybdenum | 7–9 |
| Niobium* | 3 |
| Titanium | 1.2–1.5 |
| Aluminum | 0.05–0.25 |
| Iron | 2–14 |

*(Columbium)

and the balance essentially 57–60% nickel.

34. The alloy of claim 33 containing containing 0.1% Max carbon, 0.2% Max. each silicon and manganese, and 0.006% Max. boron.

* * * * *